US008216248B2

(12) United States Patent
Brown et al.

(10) Patent No.: US 8,216,248 B2
(45) Date of Patent: Jul. 10, 2012

(54) METHOD AND APPARATUS FOR AFFECTING CONTROLLED MOVEMENT OF AT LEAST A PORTION OF THE BODY

(76) Inventors: Whitney Brown, Feeding Hills, MA (US); Loutfallah Georges Chedid, West Newton, MA (US); Portia Lane, South Portland, ME (US); Nicolas Peterson, Spencer, MA (US); Gary Rogers, Walpole, MA (US); Jake Tisdale, Monmouth, ME (US)

( * ) Notice: Subject to any disclaimer, the term of this patent is extended or adjusted under 35 U.S.C. 154(b) by 1218 days.

(21) Appl. No.: 11/780,080

(22) Filed: Jul. 19, 2007

(65) Prior Publication Data

US 2008/0104763 A1 May 8, 2008

Related U.S. Application Data

(60) Provisional application No. 60/832,241, filed on Jul. 19, 2006.

(51) Int. Cl.
*A47C 20/00* (2006.01)

(52) U.S. Cl. ..... 606/119; 606/121; 606/122; 606/123; 606/124; 5/108; 5/109; 5/630; 5/636; 5/655; 5/657

(58) Field of Classification Search ..... 700/245; 5/630, 636, 108, 109, 655, 657; 606/119, 606/121, 122, 123, 124
See application file for complete search history.

(56) References Cited

U.S. PATENT DOCUMENTS

| | | | | | |
|---|---|---|---|---|---|
| 2,481,716 | A * | 9/1949 | Black | 356/125 |
| 3,124,126 | A * | 3/1964 | Spinks | 606/242 |
| 3,740,011 | A * | 6/1973 | Dickson et al. | 248/183.4 |
| 4,249,527 | A * | 2/1981 | Ko et al. | 128/204.18 |
| 5,103,511 | A * | 4/1992 | Sequin | 5/607 |
| 5,220,699 | A * | 6/1993 | Farris | 5/636 |
| 5,276,927 | A * | 1/1994 | Day | 5/622 |
| 5,513,458 | A * | 5/1996 | Dehli | 40/470 |
| 5,601,570 | A * | 2/1997 | Altmann et al. | 606/130 |
| 5,625,913 | A * | 5/1997 | Singleton | 5/609 |
| 6,263,526 | B1 * | 7/2001 | Tu | 5/109 |
| 7,430,773 | B2 * | 10/2008 | Brown et al. | 5/601 |
| 2010/0229306 | A1 * | 9/2010 | Reeder et al. | 5/637 |
| 2011/0265264 | A1 * | 11/2011 | Reeder, Jr. | 5/640 |

* cited by examiner

*Primary Examiner* — John Nguyen
*Assistant Examiner* — Kyung Kim
(74) *Attorney, Agent, or Firm* — Intrinsic Law Corp

(57) ABSTRACT

A system for assisting and controlling the movement of a portion of a body, such as the head or head and neck is disclosed. The system and the methods of using and controlling the system can be effective in preventing and treating various conditions relating to the movement and positioning of the body or parts of the body. As such, the system can be effective in preventing and treating occipital flattening, plagiocephaly, cervical muscle tightening, torticollis, and other conditions.

6 Claims, 24 Drawing Sheets

(A) (B)

(B)

1202

| DRIVE LOGIC | | | | |
|---|---|---|---|---|
| Coil | Step 1 | Step 2 | Step 3 | Step 4 |
| 1 | 1 | 0 | 0 | 1 |
| 2 | 1 | 1 | 0 | 0 |
| 3 | 0 | 1 | 1 | 0 |
| 4 | 0 | 0 | 1 | 1 |

(A)

METHOD AND APPARATUS FOR AFFECTING CONTROLLED MOVEMENT OF AT LEAST A PORTION OF THE BODY

I. RELATED APPLICATIONS

The present application claims the benefit of Provisional Application Ser. No. 60/832,241, entitled "Plagiocephaly Solution: An Apparatus to Prevent and Treat Infant Head Flattening," filed on Jul. 19, 2006, which is hereby incorporated by reference in its entirety.

II. TECHNICAL FIELD

The present disclosure relates to methods and systems for controllably moving at least a portion of a body such as the head or the head and neck, which can be used for example to prevent or treat infant head deformation occurring in young children whose necks have limited mobility and whose bodies are subjected to the effects of gravity over prolonged periods of time.

III. BACKGROUND

This application addresses a common condition resulting in head deformation in infants. Deformational occipital flattening, known as plagiocephaly (Greek: "oblique head") for asymmetric forms and brachycephaly (Greek: "short head") is the most common type of abnormal head shape. Plagiocephaly is believed to be caused by prolonged or repetitive external force (e.g., gravitational weight of the head or brain) applied to an infant's head. For example, with an infant habitually placed on its back to sleep, the weight of the infant's head, including the weight of the brain and other tissue within the head, provides a downward force on the posterior portion of the infant's skull. Anterior-posterior strain on the cranium can cause or exaggerate this effect. Since the skulls of infants are growing, an infant habitually laid on its back can develop a deformation of the skull which in some cases is observed as an excessive flattening of the head. The result of plagiocephaly is an apparent, unsightly, and perhaps harmful shape deformation of the skull, which in some cases affects the appearance of the child's face and can be permanent if not addressed and treated early on. Plagiocephaly, or asymmetrical flattening, is quantified using oblique cranial measurements, of transcranial difference. Landmarks for these points vary, but the average normal difference is 3-4 mm. Brachycephaly, or symmetrical flattening, is quantified using cephalic index ("ci") representing the ratio of the width and the length of the head. The width of the head can be measured as the distance between the right and left euryon ("eur" and "eul" respectively), while the length of the head can be measured as the distance between the glabella ("gb") to the opisthocranion point ("op"). The cephalic index ("ci") is therefore $$ci=(((eur-eul)*100)/(gb-op))$$

and is considered abnormal if it is two standard deviations above or below the mean values. Cephalic index values for infants up to 12 months old have been measured and typically range between 80-85.

Plagiocephaly is a type of calvarial deformity that has been recognized since antiquity, but the incidence of clinically-significant plagiocephaly and brachycephaly has increased in Western societies following the 1992 American Academy of Pediatrics ("AAP") recommendations for supine infant positioning ("Back to Sleep Campaign"). This campaign appears to have contributed to decreasing the incidence of sudden infant death syndrome (SIDS), but has resulted in a rise in the number of infants with occipital flattening. Some reports estimate rates of occipital flattening in young children to be as high as 20% at 2 years of age.

More technically speaking, the occipital deformational processes are believe to be a result of regional calvarial growth restriction from sustained contact with a flat resting surface. In most cases, the affected infants have poor head rotation related to tight cervical muscles (torticollis) which are a result of limited head movement in-utero. The neck muscle contracture persists after birth, so the infant's head position can assume a similar position to that held prior to delivery, and the infant's neck muscles may not be sufficiently developed to cause proper head movement after birth. Supine positioning, as recommended by the AAP, places the expanding occiput against a typically flat resting surface. The downward (gravitational) force acting on the infant's head is resisted by an equal and opposite force from the resting surface (pillow or mattress).

FIG. 1, adapted from the public domain, illustrates a normal profile (A) of a child's head and a distorted profile (B) of a child's head suffering from positional plagiocephaly. The distorted profile (B) shows how flat spots, angular effects, and relative misalignment of one ear relative to the other is possible. A general shape of the head in both profiles is indicated by the dashed lines, with the external gravitational force being indicated by the arrow and the letter "g" above.

With infants experiencing cervical tightness, these infants may not be able to reposition their heads sufficiently to redistribute the forces opposing calvarial expansion. Hence, the head resting surface will continue to resist calvarial expansion until the infant has sufficient strength and motor development to overcome the neck contracture (usually at 3-4 months). The degree of neck muscle contracture and the rate of neuromuscular development, both of which vary considerably in new-born infants, can determine how long this process persists and, therefore, determine the severity of the head flattening. For this reason, conditions that cause more prenatal head restriction (e.g. oligohydramnious, multiple births, large infants, etc.) may be more likely to cause occipital flattening. Also, conditions that protract neuromuscular maturity (e.g. prematurity or developmental delays) may lead to a longer period of occipital growth restriction and greater head flattening.

One present attempted solution to treat plagiocephaly is a special molding helmet onto the affected child's head in an attempt to correct the condition. This approach is an active reshaping approach, and its results are not favorable if the condition has developed beyond a certain stage. This solution is not ideal as it is unsightly and uncomfortable for the child and its family. In addition, this solution does not prevent the condition before its occurrence, and does not address the concurrent problem of torticollis.

Other attempts to treat plagiocephaly include placing a child on an angled cushion that causes the child to rest at an angle out-of-plane with the child's mattress (and in other words not normal to the direction of gravity's pull). This solution is not ideal because it is uncomfortable for the child and requires the child's parent to constantly get up and move the child or adjust the cushion on which the child is resting, which in turn disturbs the sleep of both the child and the parent.

Other (non-helmet) solutions to treat plagiocephaly include orthotic devices that can be classified into two general classes: resting surface alterations, and repositioning devices. Resting surface modifications attempt to increase the contact surface area between an infant's head and the head resting surface. Typical resting surface modifications include: memory foam, contoured pillows, cut-out surfaces, and slings. Each of these solutions has design characteristics that limit their usefulness.

Repositioning devices attempt to vary the point of contact between the surface and the infant's occiput (e.g., wedge-shaped cushions). These repositioning devices offer little if any benefit to infants with established plagiocephaly, and have not been demonstrated to prevent plagiocephaly. For example, wedges do not address the limited neck motion (torticollis) in infants. Also, even with consistent use, the at-risk infant will still lay with its head rotated to one side and positioned against a flat surface, and relies on constant and proper adjustment by the infant and the device by the infant's parent. Continuous adjustment of the infant or the device is tiring and difficult for most parents, who are reluctant to continually wake their sleeping infant and get up themselves during the night. Furthermore, wedges ate relatively ineffective after about 4 months of age because of increased mobility of the child. Most infants are able to roll over at 5 months and can roll off of these orthotic devices.

In summary, the present attempted solutions to treat plagiocephaly are not effective, and requite active and proper administration by the child's parent, which the parent may not perform properly causing other or further harm, or which the parent may not be willing or able to do, or which the parent may neglect or forget to do. These attempts also do not effectively address the neck motion (torticollis) problems of infants that place them at risk of plagiocephaly in the first place.

IV. SUMMARY

The present disclosure describes one or mote embodiments of an electromechanical device that rotates the infant's head throughout the night and relieves the external (e.g., gravitational) pressure about any one area of the head to prevent and minimize plagiocephaly. Also, in children whose necks or neck muscles are not fully or properly developed, the embodiments provided herein can prevent or alleviate the adverse effects of such neck conditions, sometimes called torticollis.

The present embodiments include systems with a software (computer) program interfaced with electrical and mechanical components used for rotation of a head plate and shaft. This allows for controlling the speed of the testing plate as well as the rotation angle. The loads on the infant's head are therefore distributed in a time-varying fashion to reduce the possibility of head flattening, and to treat the condition if it has already developed. Furthermore, the present apparatus may alleviate or treat the limited neck motion problem in some infants, known as torticollis.

Some embodiments hereof gradually and continually adjust the position of an infant's head relative to the direction of the external gravitational force. It should be appreciated that the movement of the present system is typically gradual to mean that large sudden movements are avoided, but the present gradual movement does include very small discrete movements (e.g., one or two degrees tilt at a time) which ate not distracting or alarming to a child and which will not wake a sleeping child. That is, small discrete movements created by servo, electro-mechanical drives, motors, stepper systems, and the like may operate strictly gradually or may approximate a strictly gradual motion through small discrete steps.

Other embodiments hereof gradually and continually adjust the position of the infant's entire body relative to the direction of the external gravitational force. That is, the entire body of the sleeping infant may be moved instead of only the infant's head or upper body. This can be useful for infants to move their heads with respect to the external gravitational force, but if the infant's body does not require relative movement of the head and the rest of the body.

Still other embodiments hereof provide one or more axial movements of some or all of an infant's body. For example, the present embodiments can cycle the head or body of an infant in a side-to-side rocking, rolling, or other motion about an axis generally parallel to the infant's head-to-toe or spinal axis. Other motions can tip the infant's head or body along an axis perpendicular to the head-to-toe or spinal axis, or in a "yawing" direction. Still other motions can include combinations of these movements and simultaneous or alternating stepping in multiple axes.

Some of the present embodiments comprehend periodic movement of the infant or part of the infant. For example, the apparatus may cycle the infant's head from left to right with a set periodicity that can be fixed or adjustable. The periodicity can be on the order of several minutes in some embodiments, and can depend on a regiment advised in view of a cid's specific age and condition. In other embodiments, the present system can be moved in a controlled but random or pseudo-random cycle that is therapeutically favorable or comforting to the infant or that simulates a natural random movement of the infant within the mother's womb.

Other embodiments hereof provide gentle intermittent motions or sequences of motions, with a rest or pause period in between the intermittent motions or sequences of motions. The motions or sequences of motions and the rest or pause periods can be programmed, pre-set, or controlled.

Mechanically, universal joints, bearing, gears, lead screws, and mechanical interlocks and safety stops are integrated for use with one or more embodiments as described below to permit the desired range of motion.

Still other embodiments hereof include auxiliary aspects such as controlled vibration, artificial warming, cooling, auditory, or other climate and environmental controls for the health or comfort of the infant. Some or all or the present features may be activated automatically or manually, including by software control, embedded systems, firmware, hardware, manual switches, buttons, slider controls, or dial knob controls. Alarms (local and/or remote), monitoring interfaces that permit tracking and logging of the operation and history of the present systems is also a feature of some or all embodiments hereof. In yet other embodiments, programmed logical execution of steps and logical decision paths is used to control, operate and monitor the system.

In still other embodiments, the system can be integrated for use in the context of other medical systems, e.g., systems for treating or monitoring the respiratory, pulmonary, nervous, or other systems of the infant's body.

In some aspects, the present embodiments require little or no adjustment or alteration to operate with a range of infant head sizes, weights, and shapes, and a variety of infant sizes and ages. In other aspects, the present embodiments are relatively inexpensive and call for little or no professional clinical attention to use and operate. In yet other aspects, the design of the present embodiments can allow continuous stretching of the cervical muscles to facilitate resolution of concurrent torticollis in infants. This may reduce or eliminate the need for costly and time-consuming physical therapy. In still other aspects, the present modality may provide continuous muscle stretching, which may be more effective than intermittent treatment of the condition described above. In other aspects, the present embodiments are relatively easy to use, and require minimal parent instruction and input to operate correctly. Additionally, in some aspects, one or more safeguards are built into the present embodiments to prevent injury to the infant.

One or more safety features are integrated into the present embodiments to prevent misuse or malfunction which would injure a child. Limit switches, electrical, mechanical, and electro-mechanical interlocks, brakes, and software fail-safe features are comprehended hereby.

V. BRIEF DESCRIPTION OF THE DRAWINGS

The present systems and methods can be better illustrated and understood in view of the accompanying drawings, in which.

VI. DETAILED DESCRIPTION

Figure 1:
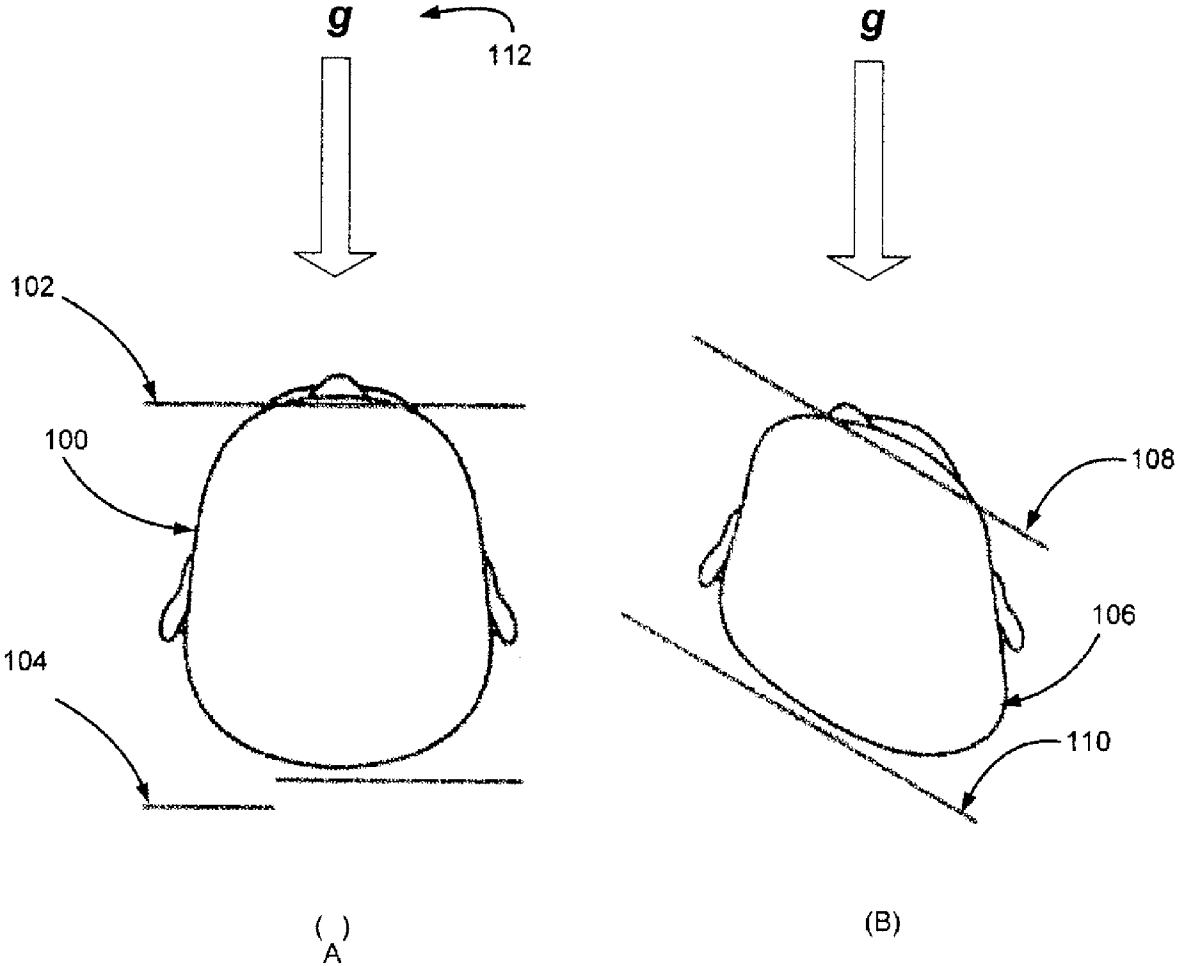
(Prior Art) FIG. 1
FIG. 1 illustrates profiles of normal and abnormal infant heads, as adapted from the public domain.

Referring now to the accompanying drawings, where the illustrations are for the purpose of describing embodiments of the present invention and are not intended to limit the invention disclosed herein:

FIG. 1 (A), adapted from the open literature on this subject, illustrates a normal profile 100 of a child's cranium with planes of symmetry drawn through the eye positions 102 being substantially parallel with the child's body and overall head testing plane 104. The external gravitational ("g") force 112 is indicated by the arrow to show the general direction of the external gravitational force 112. Note that for a child on its back, the planes 102 and 104 are substantially normal to the direction of the force of gravity 112.

FIG. 1 (B) illustrates an abnormal or distorted profile 106 of a child's cranium suffering from positional plagiocephaly which causes the plane drawn through the eye positions 108 and/or the overall head resting plane 110 to be asymmetrical and not normal to the direction of the force of gravity 112 when the child is lying on its back.

Figure 2:
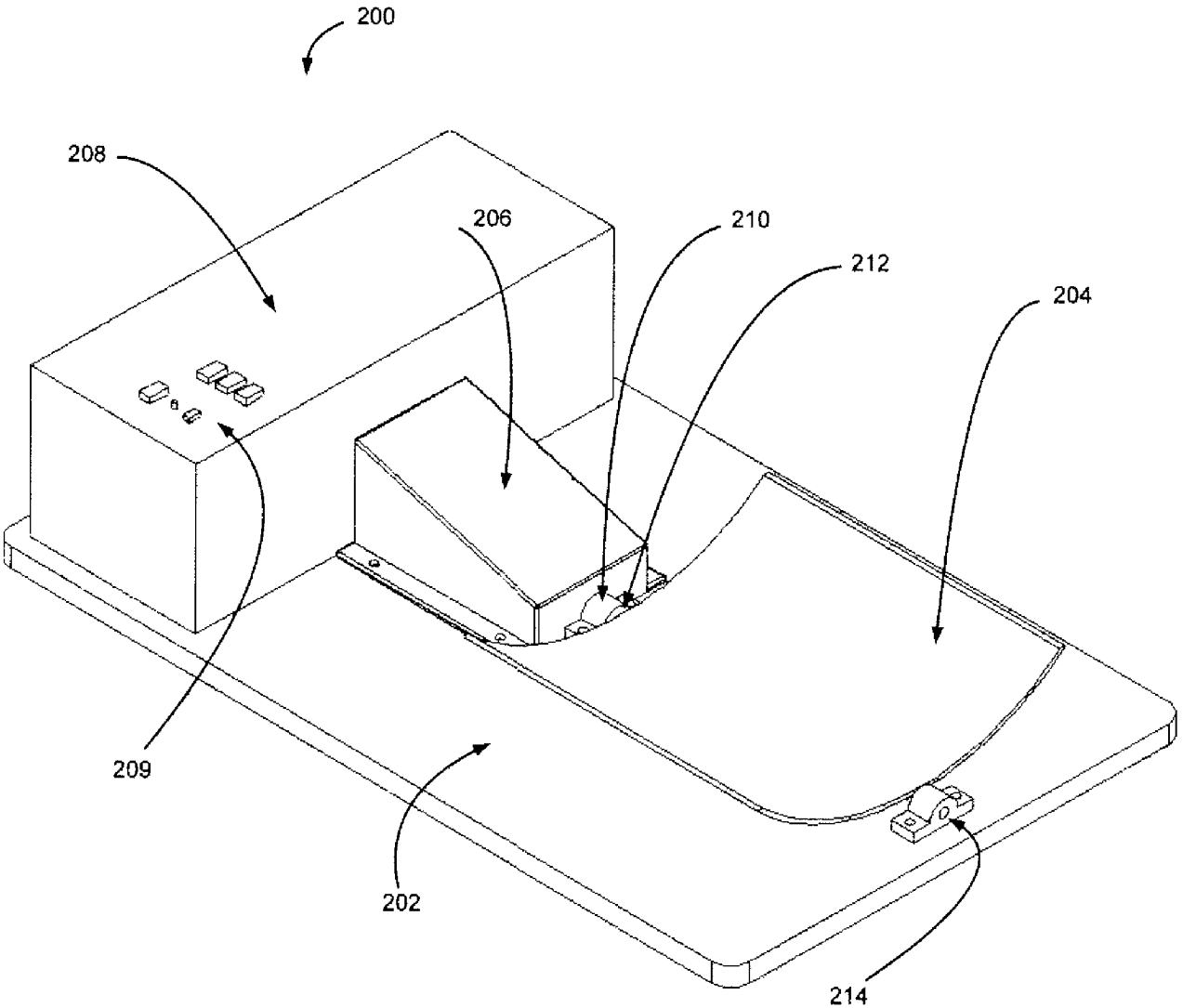
FIG. 2 illustrates a plan view of an exemplary embodiment of a system as discussed herein.

FIG. 2 illustrates an exempla system 200 for preventing and treating positional plagiocephaly and related conditions. The system includes a rigid base or platform 202 that may be constructed for example of metal plate, wooden board, plastic, or similar materials. The rigid base 202 is used to support the other elements of the system and to optionally couple the system to an existing bed, crib, or bassinet in which a child sleeps.

A head rest 204 is coupled to rigid base 202. The head rest 204 is in some embodiments formed of a rigid material such as metal, wood or plastic to securely support the child's head and any pillows or bedding or foam materials placed between the child's head and the head rest 204. In some embodiments, the head rest 204 is contoured, for example curved as shown, to better hold and secure the child's head and prevent excessive rolling of the head. Also, the head rest 204 can be shaped to better distribute external forces that cause plagiocephaly to more than just one point on the child's head. The degree of curvature of the head rest 204 can be preset or adapted by bending or attachment of inserts that give the user a range of degrees of curvature of the surface of head rest 204. In particular, for smaller infant heads, a greater degree of concavity can be applied to the head rest 204, and for larger children, a lesser degree of concavity can be applied. Curved profile inserts can be included on the upper face of head rest 204 to achieve a range of curvatures without needing to replace the rigid head rest plate itself. In one embodiment, head rest 204 may be formed of a flat surface onto which curved or contoured head rest attachments are secured. It should be noted that in some instances, actual head movement with respect to the head rest 204 is not required or desired, and that a child's resting head can be supported and treated according to the present disclosure by the act of rotation with respect to the external (gravitational) forces even if the head remains stationary with respect to the supporting pillows and head rest 204.

In some embodiments, the head rest 204 is mechanically coupled to a shaft 210, directly or indirectly, causing head rest 204 to rotate from side to side about the axis of shaft 210. The rotation is cyclical and periodic in some embodiments, but is not so limited, and may be aperiodic and acyclical in other embodiments. Also, while the drawing shows a single shaft and degree of freedom, it should be appreciated that more than one degree of freedom can be used to move head rest 204. For example, a second (or more) rigid platform, or a second set of shafts and beatings and mechanical drivers can be used to move the apparatus along second (or more) axes.

Shaft 210 is coupled by bearings 212 and 214 to rigid base 202. Bearings 212 and 214 permit the rolling or rocking cyclical motion described previously with minimal frictional resistance and with minimal noise so that the baby's sleep is uninterrupted and so that the other electrical and mechanical components of the system operate smoothly and efficiently.

A drive system is used to drive the movement of the apparatus. In some embodiments an electrical or electromechanical motor such as a stepper motor is used to drive the movement of the apparatus through a gearing system that rotates shaft 210. The drive system is housed within housing 208, and can include prime movers such as servos, solenoid controlled movers, or other electromechanical positioning systems. In some embodiments a cam system can be used to move the apparatus.

A gearing system, to be described further below, provides a mechanical way to transfer torque from the prime mover or motor to a universal joint, to be described further below, which is housed in housing 206. Bushings, couplings, and other mechanical components may be included to further refine the operation of the present system and increase its safety, durability, efficiency, or to reduce the cost of making the same.

Control panel 209 allows local control and/or monitoring of the operation of the system 200. In some embodiments, switches, dials, knobs, buttons, and display features are located at the control panel 209. Some exemplary functions that can be controlled by using the controls on control panel 209 include power ON/OFF, the speed (or cycle period) at which the head rest 204 is moved, the overall range of motion of head rest 204, the motion program including any stop or rest periods, the comfort and auxiliary features of the system, and the interface of the system to other systems.

Figure 3:
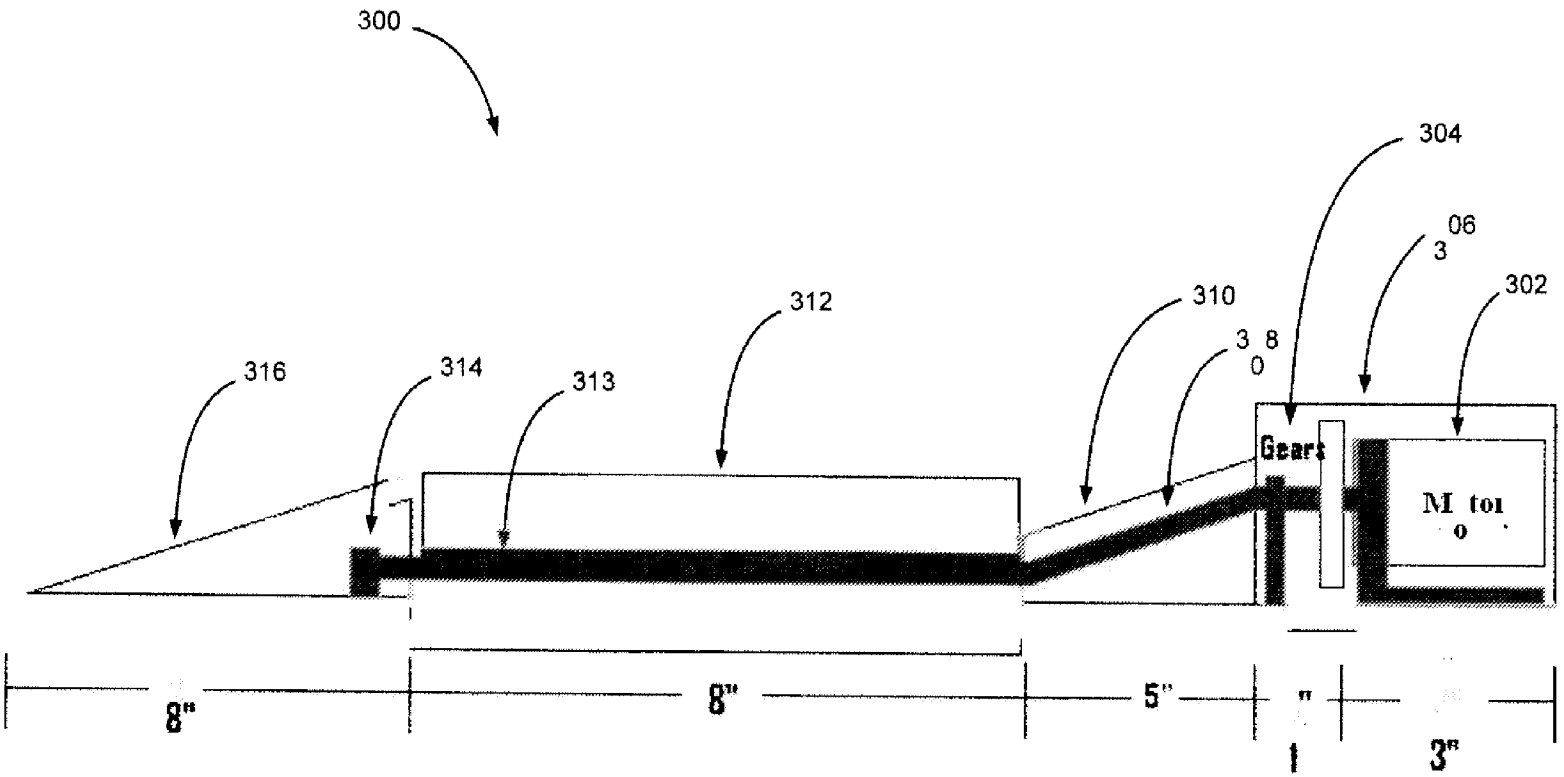
FIG. 3 illustrates a cross section of an exemplary embodiment of a system as discussed herein.

FIG. 3 illustrates a side view of a system 300 for treating plagiocephaly and other conditions mentioned herein. An electrical or electromechanical prime mover (motor) 302 drives the system's moving parts and provides torque, through a shaft, to gears 304. Gears 304 and motor 302 are housed in a protective housing 306 that keeps the moving and electrified components safely away from the touch and bedding, and also protects these parts from damage, contamination and dust. Gears 304 provide stepped up or down torque to rotate a shaft 308 of a universal joint and torque transfer system housed within housing 310. Housing 310 protects the apparatus within and the users from harm or damage.

Head rest 312 is coupled, directly or indirectly to a shaft 313, which causes head rest 312 to rotate according to a drive program programmed into a microprocessor apparatus controlling the motion of system 300. Shaft 313 may be rigidly manufactured and integral with head rest 312, or may be connected to head rest 312 by mechanical fasteners such as bolts, rivets, epoxy, hook-and-eye fasteners, and others. Shaft 313 is terminated at a bearing 314 that allows smooth and quiet and efficient rotation of shaft 313 along its major longitudinal axis. A pad 316, which can be shaped to conform to a child's body or to conform to a child bed on which the child lies substantially meets head rest 312 so as to have a relatively continuous, comfortable, and safe overall resting environment for the child's body.

Exemplary dimensions are provided in the figure, which can be modified as needed, or can be made customizable or adjustable depending on the application or the size of the subject child to be placed within the apparatus.

Figure 4:
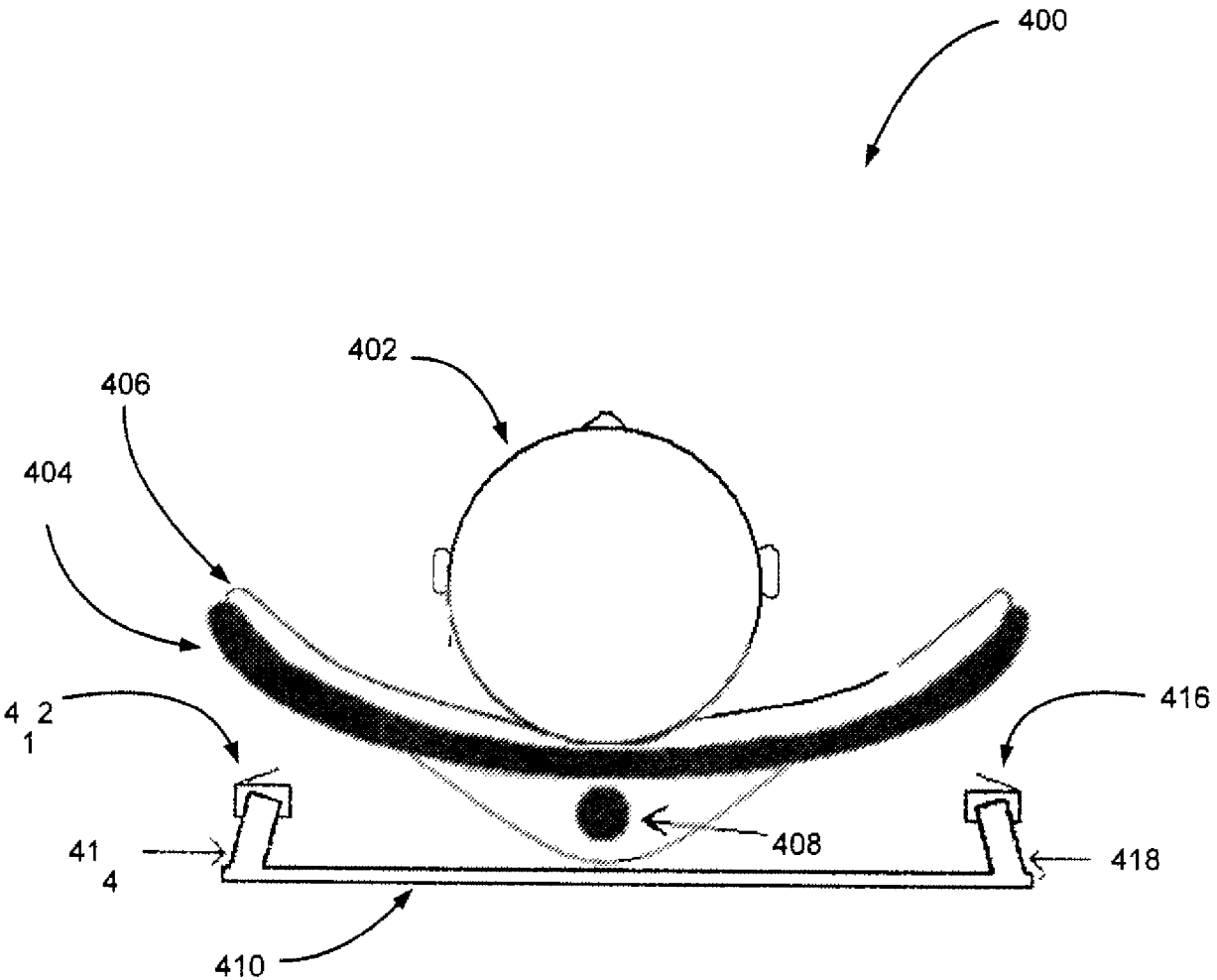
FIG. 4 illustrates another view of an exemplary embodiment of a system as discussed herein.

FIG. 4 illustrates a view of an exemplary embodiment of the present system 400, with a child's head 402 resting on a padded foam cushion 406 placed on a rotatable head rest 404. The head rest 404 can be made to controllably rotate about the long axis of a shaft 408 by way of a motor as explained elsewhere in this specification. The system is stabilized and supported on a base or platform 410 as described earlier.

The head rest 404 rocks about the axis of shaft 408 and at the furthest left and right limits of its rotational cycle activates limit switches 412 and 416 respectively. When depressed by the head rest 404, limit switches 412 and 416 indicate with respective electrical signals that the system is to reverse the direction of the rotation of head rest 404. This is done as described herein by control signals to the drive motor or other suitable means.

Embodiments of the present system are designed for safe use in home and clinical (e.g., hospital) environments on the very young. Therefore, the present system does not only employ limit switches and the control program to limit the movement of head rest 404. But in addition, the present system can be provided with emergency stops, such as mechanical structural hard stops 414 and 418, which limit the movement of the system 400 to be constrained within certain hard limits or a restricted range of angles in which the rotating head rest 404 can turn.

Figure 5:
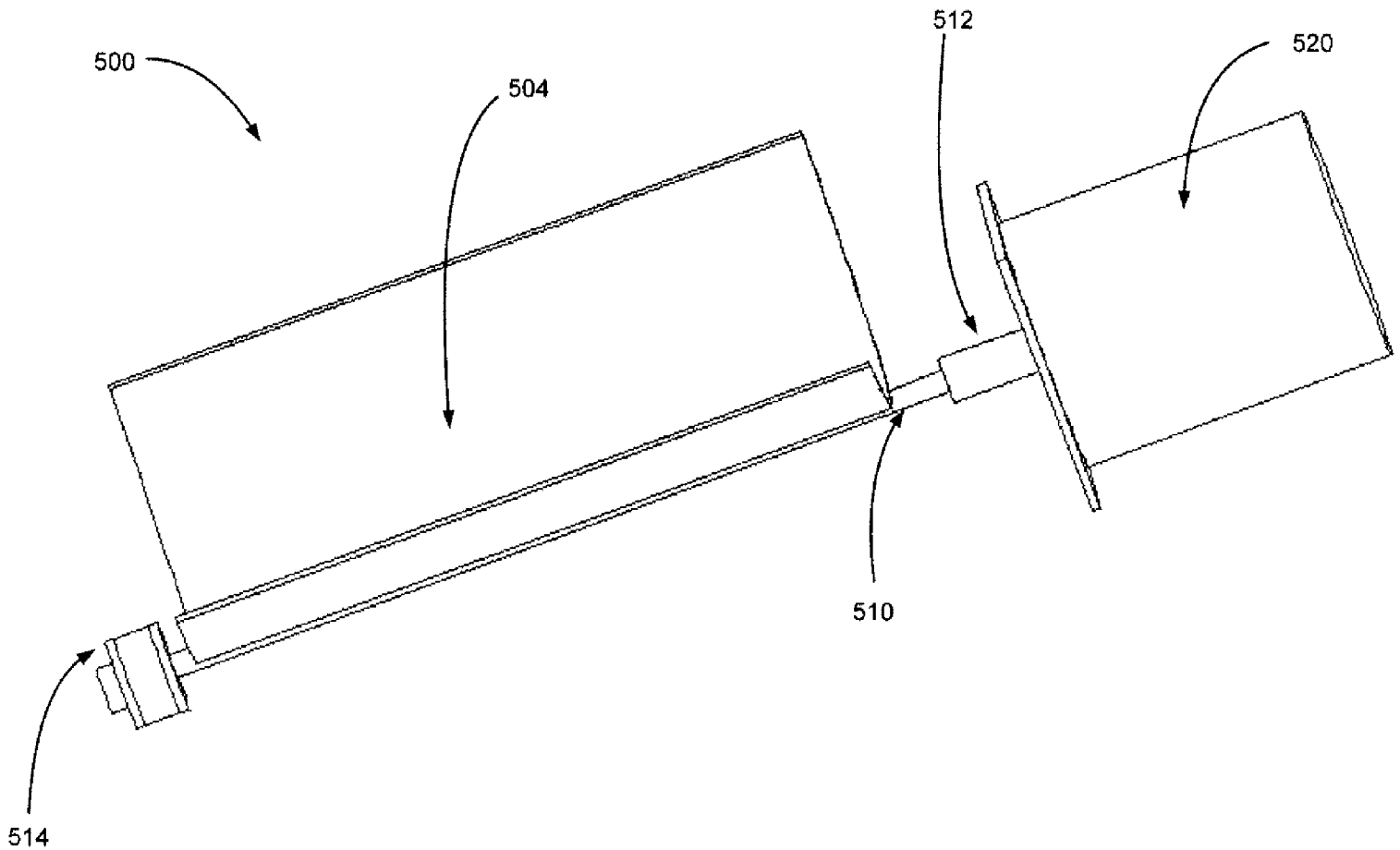
FIG. 5 illustrates an exemplary subset of components of an exemplary embodiment of a system as discussed herein.

FIG. 5 illustrates an exemplary subsystem 500 for use in an apparatus for rocking a baby's head and neck gently as the baby rests. A contoured head rest 504 is provided as discussed above for supporting the head and neck of the infant who lies, e.g., on its back. The head rest 504 is rotated about an axis of an integrated rotation shaft 510. The integrated rotation shaft 510 is formed in some embodiments as part of or mostly integrally to the formation of head rest 504 rather than as a separate mechanical component that is later affixed to head rest 504, but is not so limited. Therefore, head rest 504 and integral rotation shaft 510 can be considered in some embodiments as a single mechanical rigid component with ends that couple to bearings 512 and 3514. This integrated design encourages low-profile form factors that allow the infant to be substantially flat on a support surface while the infant's head and neck are rotated gently from side to side.

Drive motor 520, normally housed within a housing, is driven by electrical power to cause the rotation of head rest 504. The apparatus and its driving motor 520 may be powered by electricity from an AC source such as a 60 Hz 120 VAC wall outlet or from a DC power supply such as a battery that is electrically coupled to the subsystem 500. The driving motor 520 can be a direct drive type, while in other embodiments can be a belt or cam drive type.

Figure 6:
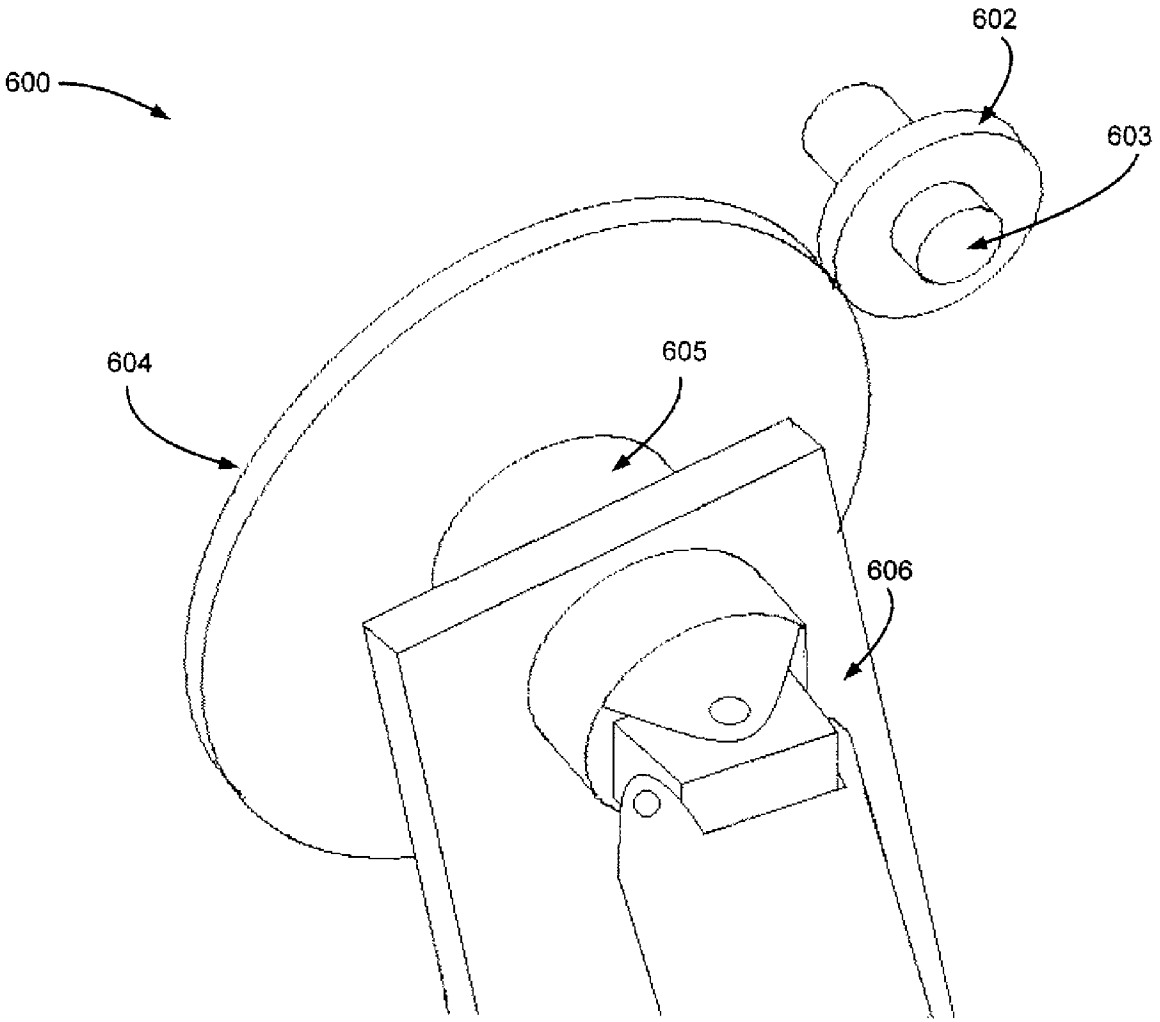
FIG. 6 illustrates an exemplar gearing arrangement for driving exemplary embodiments of the present systems.

FIG. 6 illustrates an exemplary gearing mechanism 600 for driving embodiments of the present apparatus. A smaller master or drive gear 602 is directly or indirectly driven by the prime mover motor as discussed earlier. Smaller drive gear 602 includes a plurality of "teeth" that mechanically engage and correspondingly rotate the teeth on a larger slave or power gear 604. Since the drive gear 602 has a smaller diameter than power gear 604, drive gear 602 will rotate at a greater rate (measured in revolutions per minute, or "RPM") than power gear 604. Additionally, in the process of transferring torque from drive gear 602 to power gear 604, the two gears will rotate in opposite directions. For example, while both drive gear 602 and power gear 604 rotate about parallel respective shafts 603 and 605, drive gear 602 may rotate in a clockwise direction about shaft 603 while power gear 604 rotates (at a different speed) in a counter-clockwise direction about shaft 605. The power gear 404 transfers torque through its shaft 405 to a universal joint 406.

The following equations describe exemplary gear ratios, torques, and step configurations for an illustrative pair of gears for a gear set that uses a smaller drive gear having 0.5 inches outer diameter ("O.D."), a larger power gear having a 2.5 inch O.D., a prime mover torque of 100 ounces/inch.

$$\text{Gear Ratio} = \frac{\text{Power Gear } (O.D.)}{\text{Drive Gear } (O.D.)} = \frac{2.5 \text{ inches}}{.5 \text{ inches}} = 5$$

$$\text{Torque} = 100\frac{\text{once}}{\text{inches}} * 5(\text{gear ratio}) = 500 \frac{\text{once}}{\text{inches}}$$

$$\text{Step} = \frac{1.8 \frac{\text{deg}}{\text{step}}}{5(\text{gear ratio})} = 0.36 \frac{\text{deg}}{\text{step}}$$

Figure 7:
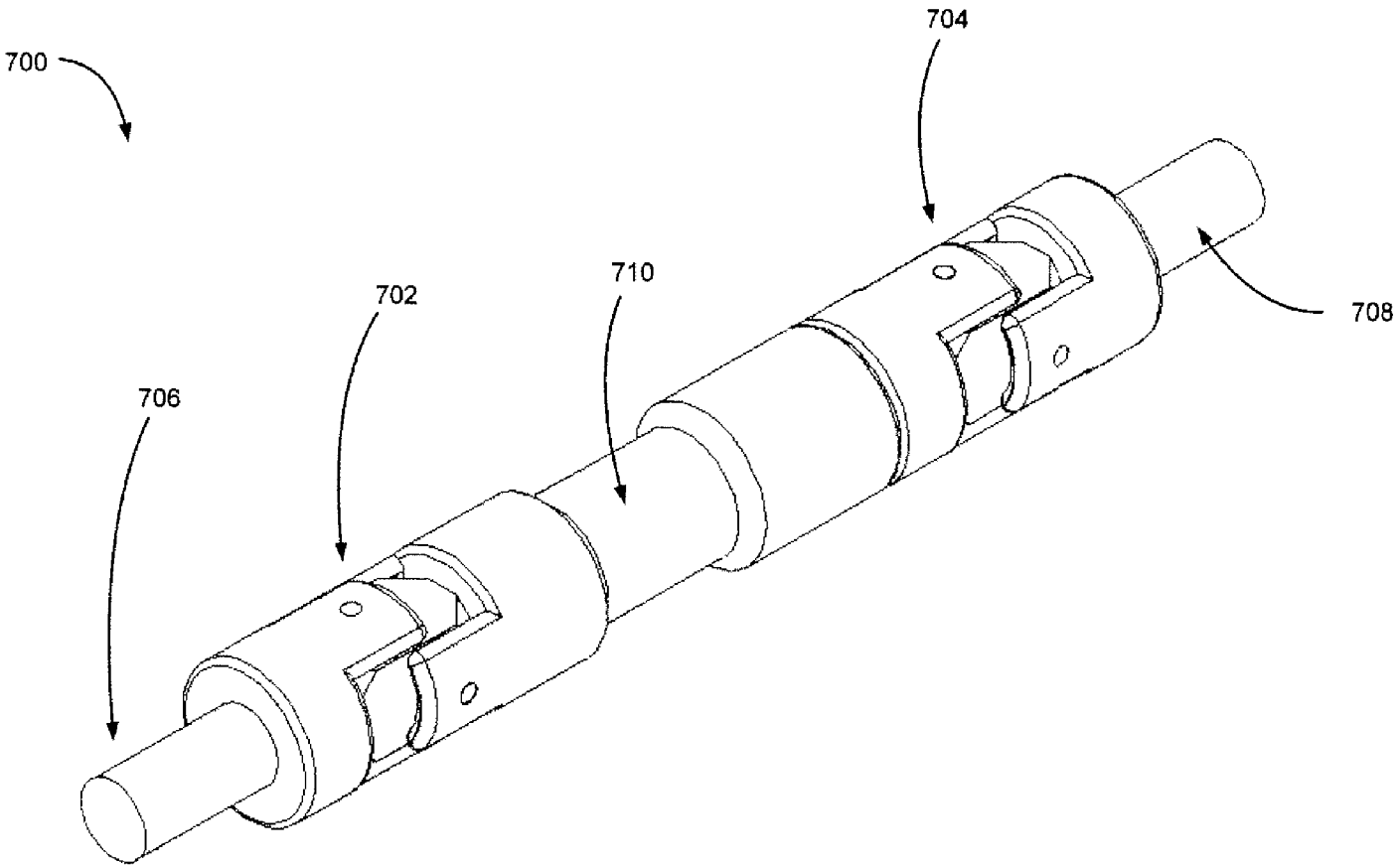
FIG. 7 illustrates a view of an exemplary mechanical universal joint assembly for use in the present systems.

FIG. 7 illustrates an exemplary universal joint assembly 700 for transferring torque and rotational force from one end of the assembly to the other. As will be illustrated further below, the universal joint assembly 700 can be used to shift the axis of rotation from one plane into another so as to allow for a low-profile system for rotating a child's head rest or sleeping surface.

As an illustration of the operation of the universal joint assembly 700, consider a driving rotational torque applied to a first (drive) shaft 706, which is coupled to a first articulated joint 702 that permits relative movement between the first shaft 706 and an intermediate coupling shaft 710. Such relative movement can be in one or more directions or degrees of freedom and allow transfer of force and torque between first shaft 706 and intermediate coupling shaft 710, and rotation of shafts 706 and 710 with each of shafts 706 and 710 rotating about a respective axis of rotation.

Similarly, a second articulated joint 704 permits transfer of force and torque from rotating intermediate shaft 710 to second (load) shaft 708, with each of shafts 710 and 708 rotating about a respective axis thereof.

Figure 8:
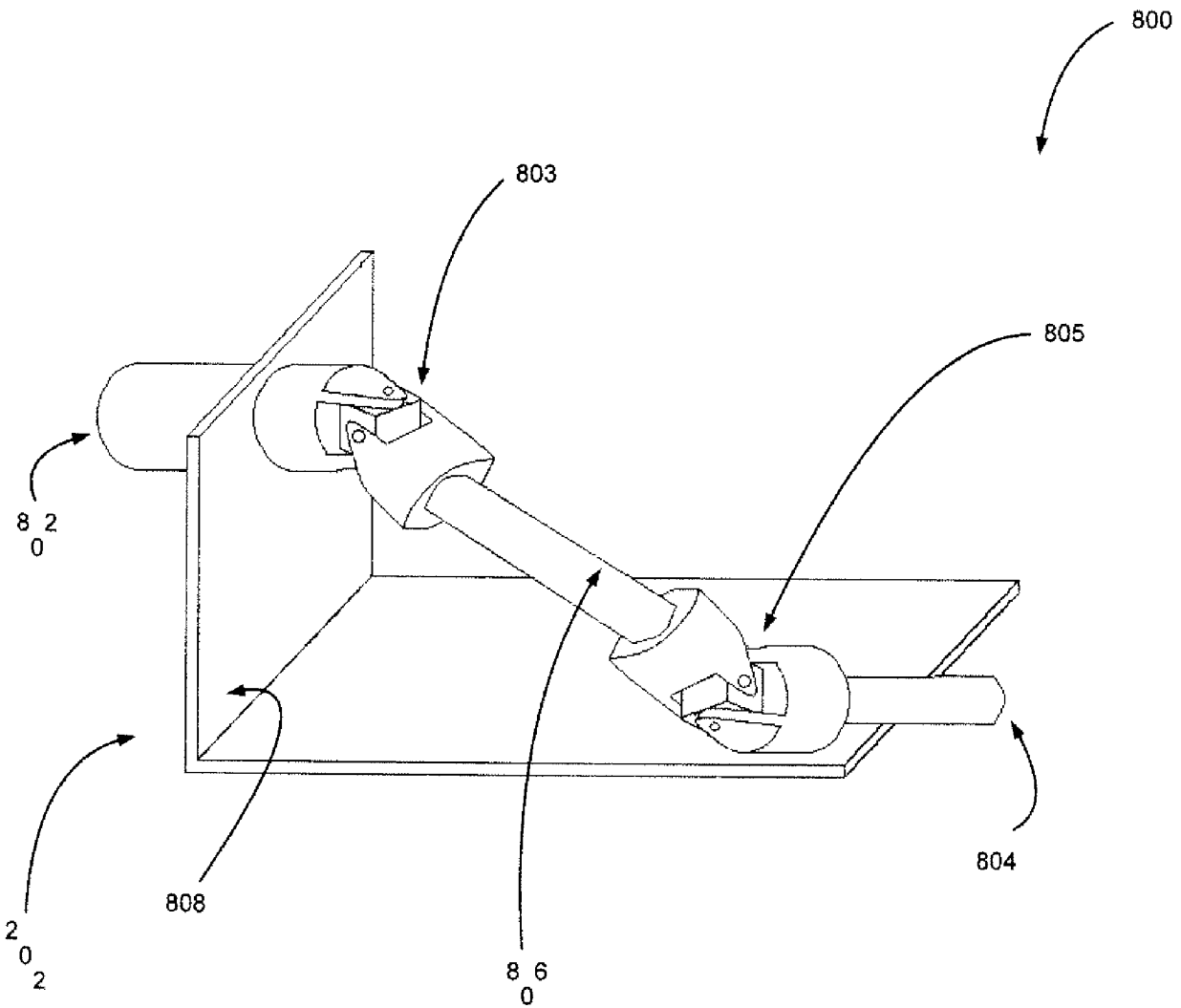
FIG. 8 illustrates another view of an exemplary mechanical universal joint assembly for use in the present systems.

Further to the explanation given above with respect to FIG. 7, FIG. 8 illustrates an exemplary embodiment of a universal joint assembly 800 for transferring torque and axial motion from a first (drive) axis 802 to a second (load) axis 804 that are operated non-coaxially, or out-of-line with one another. A pair of articulated joints 803 and 805 couple dive axis 802 to load axis 804 through intermediate axis 806. In this way, the apparatus can be rotated while maintaining a low profile against the surface of rigid support base 202. A rigid, e.g., metallic, bracket 808 with penetration for drive axis 802 is designed to secure the universal joint assembly 800 to support base 202. Note that for aesthetic, reliability, and safety reasons, universal joint assembly 800 is typically housed in a protective housing (see housing 206 in FIG. 2). This prevents unwanted contaminants from entering the joint assembly 800, and prevents bedding, hair or the baby's fingers from becoming drawn into the moving parts of the system or getting lubricating grease on them.

Figure 9:
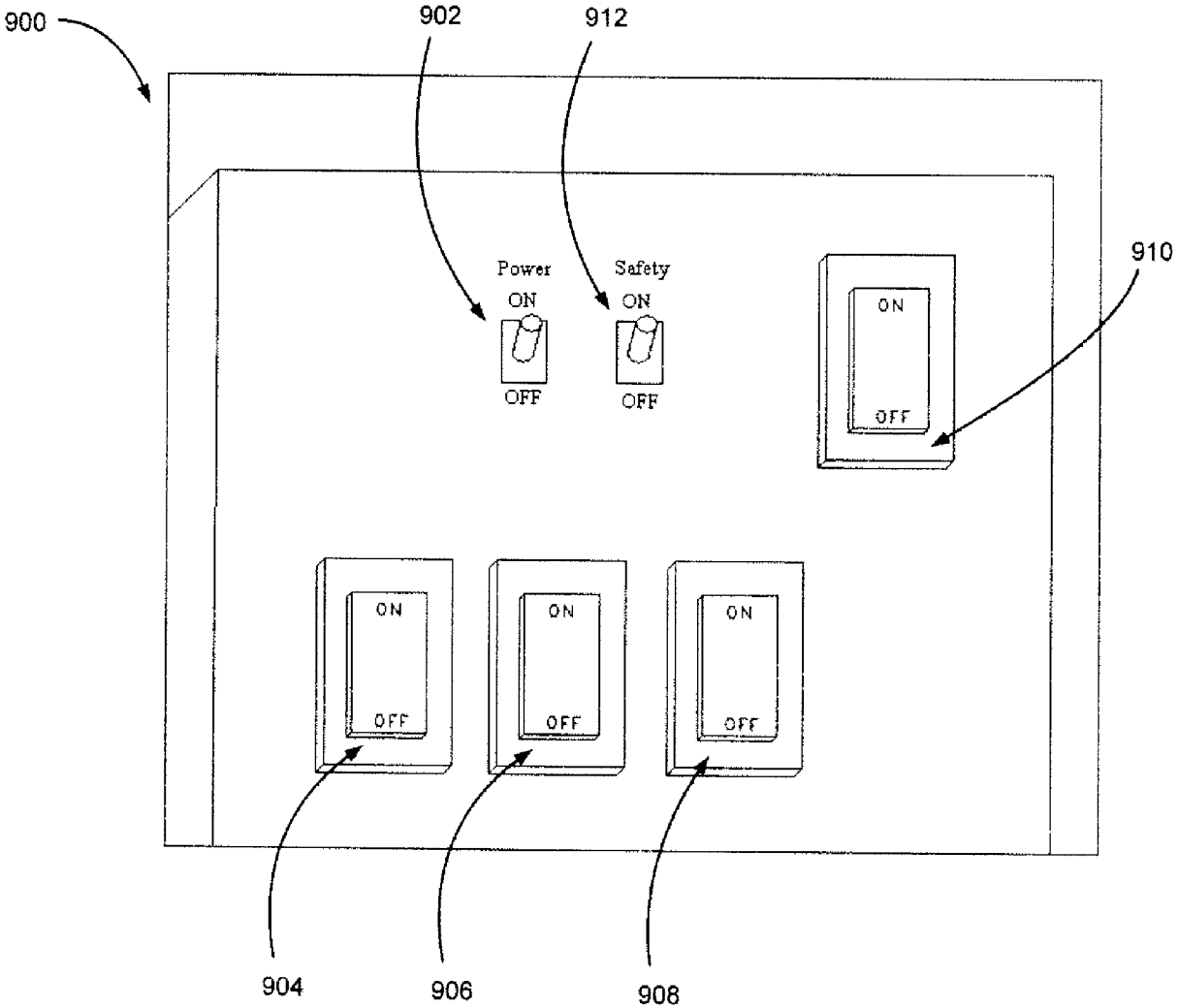
FIG. 9 illustrates an exemplary control panel for controlling the present systems.

FIG. 9 illustrates an exemplary view of one embodiment of a control panel 900 for controlling some aspects of the operation of the present device. A Power switch 902 (which can be substituted by a knob, button, soft-touch control or other manual control element) turns the power on to the system, including by powering the logic circuitry and the system's electric drive motor. A light or other visual and/or audible indicator can indicate to the user, locally or remotely, that the system is on.

In the exemplary embodiment shown, three operating rotation modes and a test rotation mode are possible. The three rotation modes are selected by way of their respective switch controls, 904, 906, 908, indicating a periodicity of 1, 5, and 10 minutes, respectively. This indicates that in some embodiments the device rocks the head rest from a start position through its full cycle of motion and back to the start position in 1, 5, or 10 minutes, respectively. In other embodiments, this can indicate that the device performs a movement every 1, 5, or 10 minutes, respectively, resting in between.

The "Test" speed switch 910 is for developmental use or testing use, and may be for example a relatively high speed mode to enable the owner or technician to troubleshoot the operation of the device. The Test mode is generally not for use with actual children, and is therefore generally envisioned to be not included in consumer or production clinical versions of the apparatus. The Test switch 910 may be concealed or protected within protective housing 206 (see, e.g., FIG. 2) such that it is only accessible to technicians who open the housing 206 in the act of repairing or testing the apparatus, but is not accessible to consumers or end users.

Figure 10:
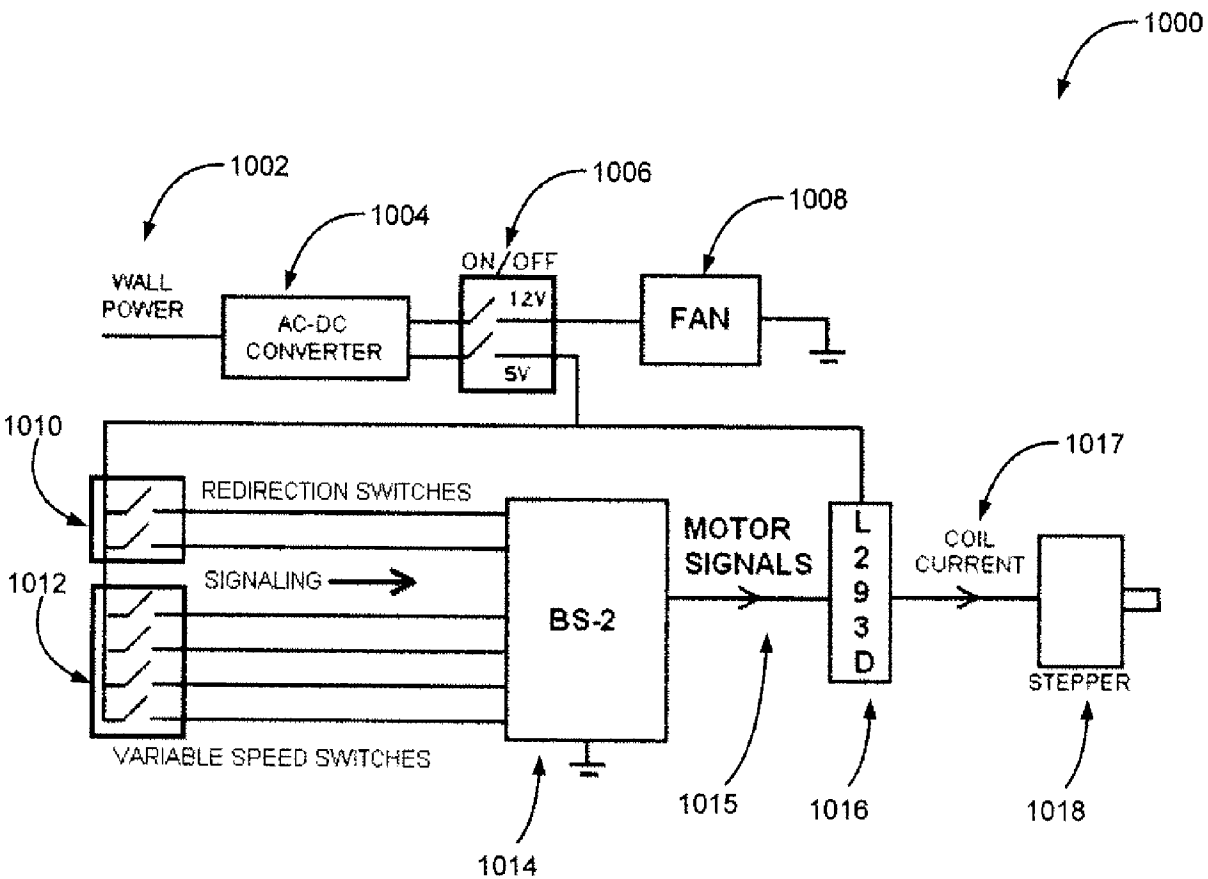
FIG. 10 illustrates an exemplary control circuit block diagram for controlling the present systems.

FIG. 10 illustrates an exemplary embodiment of a block diagram of a control circuit 1000 for controlling the present system. The circuit may include wired, soldered, integrated circuit ("IC"), printed circuit board ("PCB"), application specific integrated circuits ("ASICs") and other components, which may be designed and implemented on a single platform and communicate with one another by way of buswork.

Power for control circuit 1000 is derived from an electrical power source, for example alternating current ("AC") power from a wall socket, including for example from a standardized 110 VAC 60 Hz, or a 220 VAC 50 Hz, or other source. A plug that permits plugging the device into the wall socket supplying the AC power can be used for the purpose of coupling the device to a source of electrical power.

In some embodiments it may be preferable to convert the voltage of the power source to another voltage, e.g., a lower voltage. In this case, a voltage transformer can be employed to accomplish the transformation. Also, direct current ("DC") power may be used in some embodiments, e.g. to power a DC motor. In this case, an AC-to-DC converter is used to convert the AC power into a DC power component. The figure illustrates an embodiment where the electrical power from a wall socket at 1002 is converted using an AC-to-DC converter 1004. AC-to-DC converter 1004 may be constructed to provide mote than one output voltage, for example a first voltage output at 12 VDC and a second output voltage at 5 VDC.

A power switch 1006 as discussed with respect to FIG. 9 is used to energize the device, or turn it ON or OFF. This switch 1006 is placed in line with the power supply lines and can open to interrupt the power to the system or shut to provide power to the system. In the present embodiment, power switch 1006 opens or shuts the power circuit for both the 12 VDC and the 5 VDC portions of control circuit 1000, but this can be substituted with individual power switches for each of the DC power outputs.

A cooling fan 1008 is powered by the 12 VDC output of the circuit and cools the internal portions of the apparatus, especially the temperature-sensitive components such as the semiconductor integrated circuits. It should be understood that fan 1008 can be powered by AC power, and may include adjustable speed features, e.g., low-medium-high or continuously variable speed, and may be automatically actuated to turn on only when a certain criterion is reached (e.g., a predetermined temperature setpoint). The fan's rotational speed may also be affected automatically by a temperature sensed within the apparatus to form a simple temperature control feedback circuit.

The 5 VDC power output provided by power switch 1006 is used to power the logic and other portions of the control circuit. For example, one connection to the 5 VDC output is provided to the redirection switches 1010 that determine the switching or reversing of the direction of rotation of the device. Also, 5 VDC is provided to variable speed switches 1012 discussed with regard to FIG. 9 which control the speed at which the motor or other electro-mechanical component is moved.

Output signals from the redirection switches 1010 and the variable speed switches 1012 are sent to the "BS-2" microprocessor 1014 that provides a motor control signal 1015 that is sent to the L293D motor control 1016. In some embodiments, the microprocessor is suitable for logical operations, but is not suitable as a power driver as it cannot support the current load required to drive an electrical load such as stepper motor 1018. Motor controller 1016 can accept motor control signal 1015 and provide stepper motor 1018 sufficient coil current 1017 to drive motor 1018. As mentioned earlier, other types of prime movers can be used than DC stepper motors.

Figure 11:
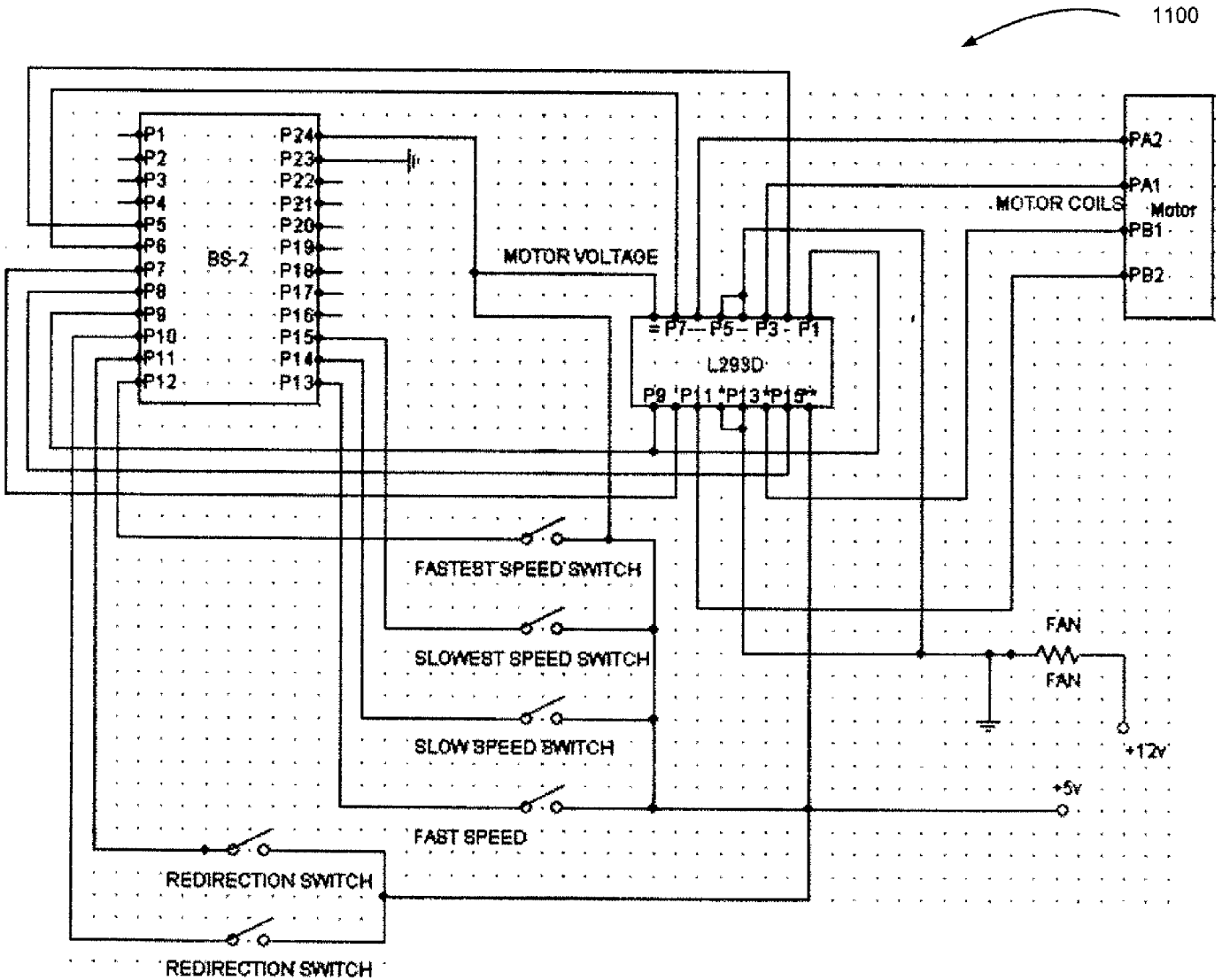
FIG. 11 illustrates an exemplary control circuit pin diagram for controlling the present systems.

FIG. 11 illustrates an exemplary circuit schematic 1100 corresponding to the block diagram of control circuit 1000 described above with regard to FIG. 10. Here the individual exemplary components and pin-outs from the integrated circuits are illustrated in further detail.

By way of example, in operation, the device is turned on through an "on/off" switch that supplies power to the system. The program instructions in the BS-2 microprocessor identify the BS-2 microprocessor and execute program instructions written in the PBasic language v2.5 for example. This is not intended as a limitation on the operation of the device, but rather as an illustration of one or more embodiments thereof. Next, names for the Coil Pins, Enable Pin, Direction Pins, and Speed Pins are assigned. "X" is labeled as a variable numeric value and the Enable pin is driven high turning on the L293D. Pins labeled P5-P10 are driven low to assure that the chip is in the beginning state.

Node 2 brings the program to the beginning of the COUNTERCLOCK loop. P5 is examined and if it is LOW it will ENTER COUNTERCLOCK1 (as Step 1 which is labeled CC1). Pins P7-P10 are tested for a HIGH signal. The HIGH pin that is recognized will then set its corresponding X value and PA1 through PB2 are set to the conditions for Step 1. Now the program sleeps or pauses for a period of ten times X leasing all pins in their current state allowing the motor to sustain its static torque. Once PAUSE has run out the program will RETURN to check pin P5, and if LOW will ENTER CC2. Following CC2 this repeats again for CC3 and CC4 where the programs will then GOTO COUNTERCLOCK to repeat the logic loop until P5 goes HIGH.

With P5 HIGH, the program will GOTO CLOCK seen at Node 10. Here P6 is examined and if it is LOW will ENTER CLOCK1 (C4). Pins P7-P10 are tested for a HIGH signal. The HIGH pin will set its corresponding X value, and PA1 through PB2 are set to the conditions for Step 4. The program then sleeps or naps for ten times X while leaving all pins in their current state allowing the motor to sustain its static torque. Once the PAUSE has run out, the program will RETURN to check pin P6, and if LOW will ENTER C3. This repeats again for C2 and C1 and will GOTO CLOCK to repeat the loop until P6 goes HIGH. Once P6 is HIGH, the program will GOTO COUNTERCLOCK again, and this process repeats until the device is shut down or is interrupted by pending safer circuits. The foregoing description is given by way of example, and is not intended to limit the many similar and equivalent ways of programming and operating the present system which fall within the present scope.

Figure 12:
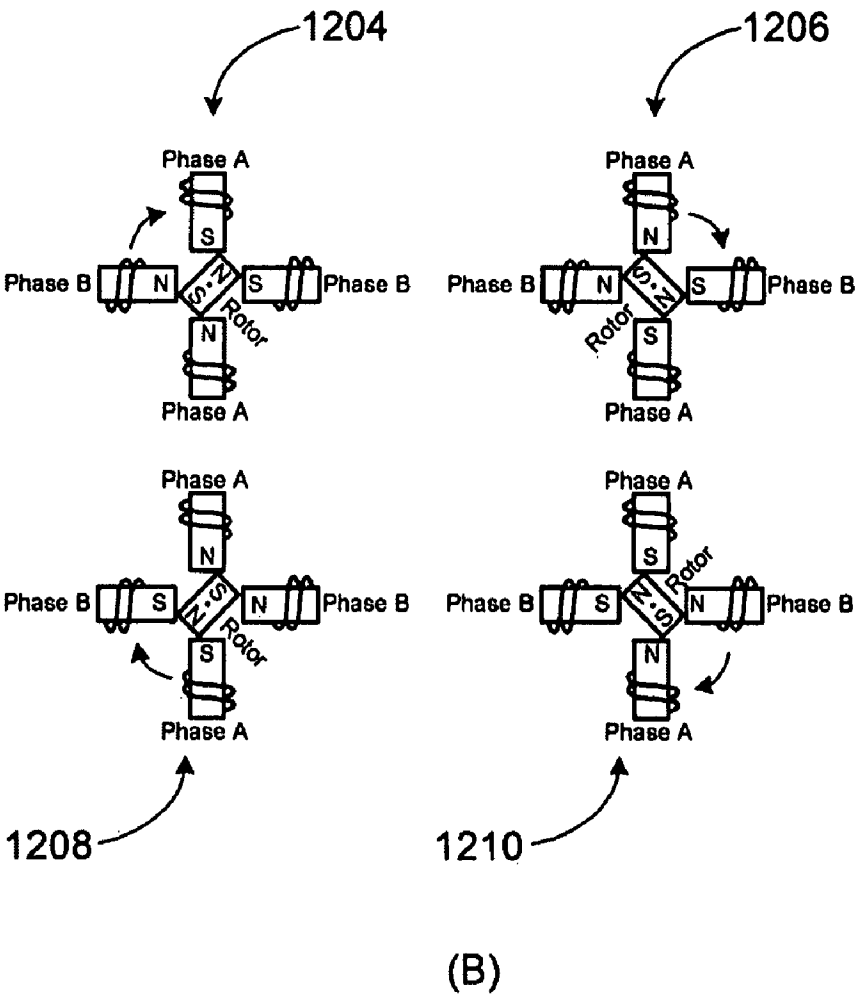
FIG. 12 illustrates an exemplary drive logic chart and a corresponding diagram of stepper motor phases.

FIG. 12 (A) illustrates an exemplary drive logic chart 1202 that shows the coordinated energizing of four drive coils for the stepper motor 1018 of FIGS. 10 and 11 to cause a controlled directional rotation of the motor 1018. It can be seen in this example that Coil 1 is energized at Step 1 and Step 4; Coil 2 is energized at Step 1 and Step 2; Coil 3 is energized at Step 2 and Step 3; and Coil 4 is energized at Step 3 and Step 4.

FIG. 12 (B) illustrates graphically the rotation of a central rotor within a DC stepper motor having four coils, here referred to as Phases A, B, C, and D. Snapshots of the four Steps ate indicated in the diagrams 1204, 1206, 1208, and 1210.

Figure 13:
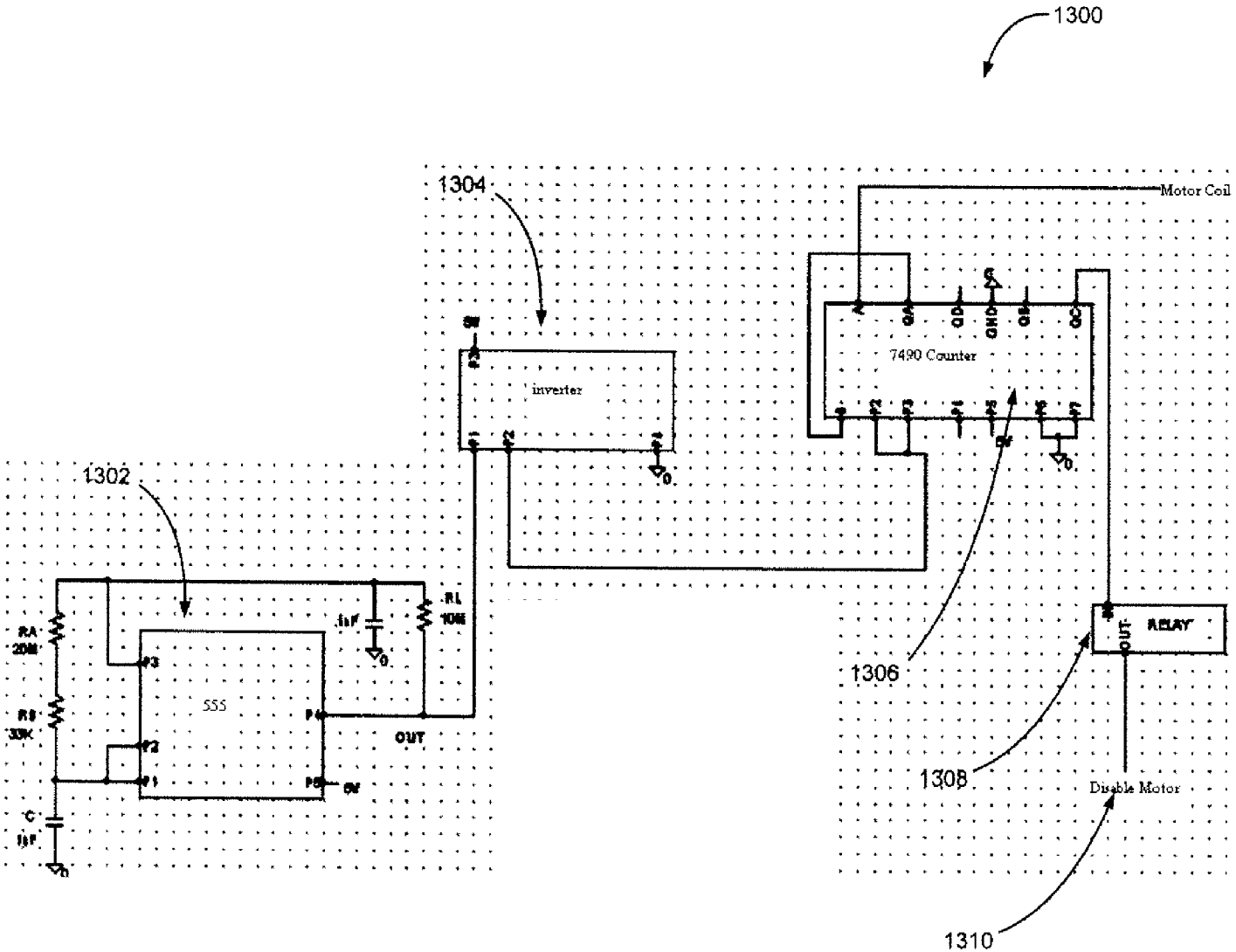
FIG. 13 illustrates an exemplary security circuit for use with the present systems.

FIG. 13 illustrates a "security" circuit 1300 for monitoring the movement of the stepper motor. The security circuit 1300 includes circuitry and logic for determining the number of times the stepper motor coils are energized. Specifically, security circuit 1300 includes a counter circuit 1302 that counts the number of times the stepper motor coils are energized with a HIGH signal. Inverter 1304 allows for a relatively long HIGH period between quick reset pulses to counter 1302.

Security circuit 1300 is adapted in some embodiments to shut down power to the stepper motor, for example by way of a normally-closed (energized) power relay that controls the power delivered to the stepper motor and interrupts the power as necessary. Alternatively, a normally-open (deenergized) power relay could be used which would energize to activate a DC brake to stop the movement of the device. A separate source of power could power the DC brake in some embodiments.

The present embodiments of the system can include microprocessors that execute program instructions to control the system as discussed elsewhere herein. The programmed microprocessors can be interfaced to external systems such as workstations, personal computers, user interface devices, or a network (e.g., local area network, wide area network, wireless network, or the Internet) to receive program instructions. Program instructions can be prepared on an external computer using programming and debugging or simulation tools, then downloaded in a form usable by the system's microprocessors. Hard coding of computer instructions into memory (such as PRAM, ROM, etc.) may be employed in some embodiments. The program instructions may be updated, corrected, or replaced by service technicians who can rewrite the instructions stored in the memory of the device.

As discussed above, these components and processors can be implemented in software, hardware, firmware, or various combinations thereof, and the present illustrative demarcation of the functions and block diagrams and components described can be accomplished flexibly in more than one way. For example, one or more additional components may be incorporated into the present system, or a single component can be constructed to perform the functions of two or more components described in the present preferred embodiments. The BS-2 microprocessor described above is an example of a collection of circuitry and logical components, that interfaces with a digital storage medium to execute the functionality of the present system.

Figure 14:
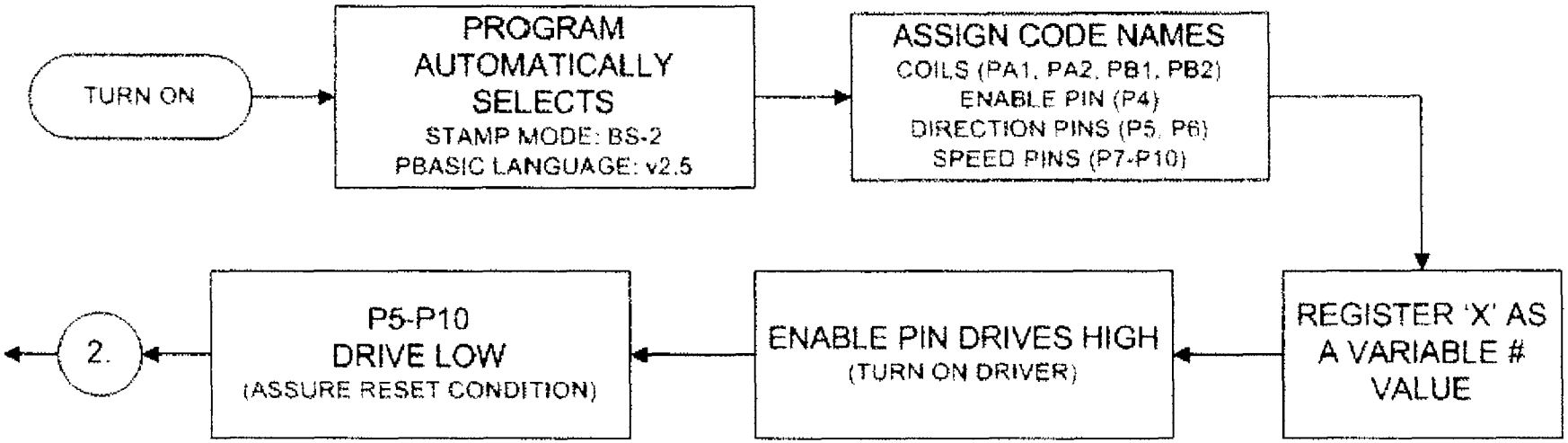
FIGS. 14 (A) through (K) illustrate exemplary programmatic steps executed in controlling or operating the present systems.
Figure 14:
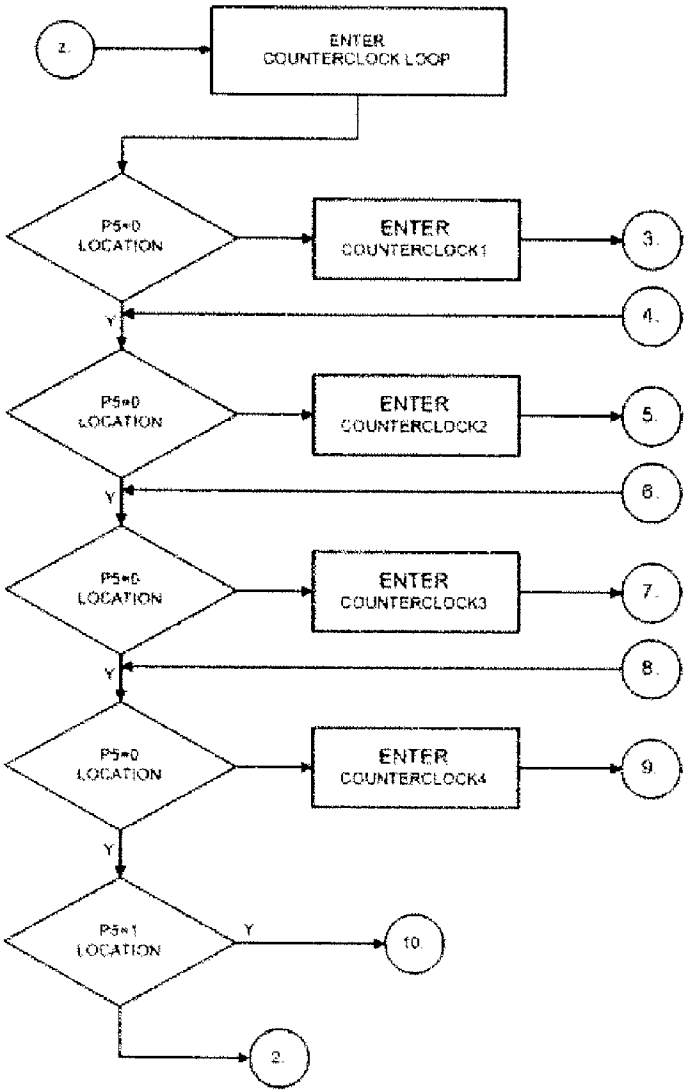
Figure 14:
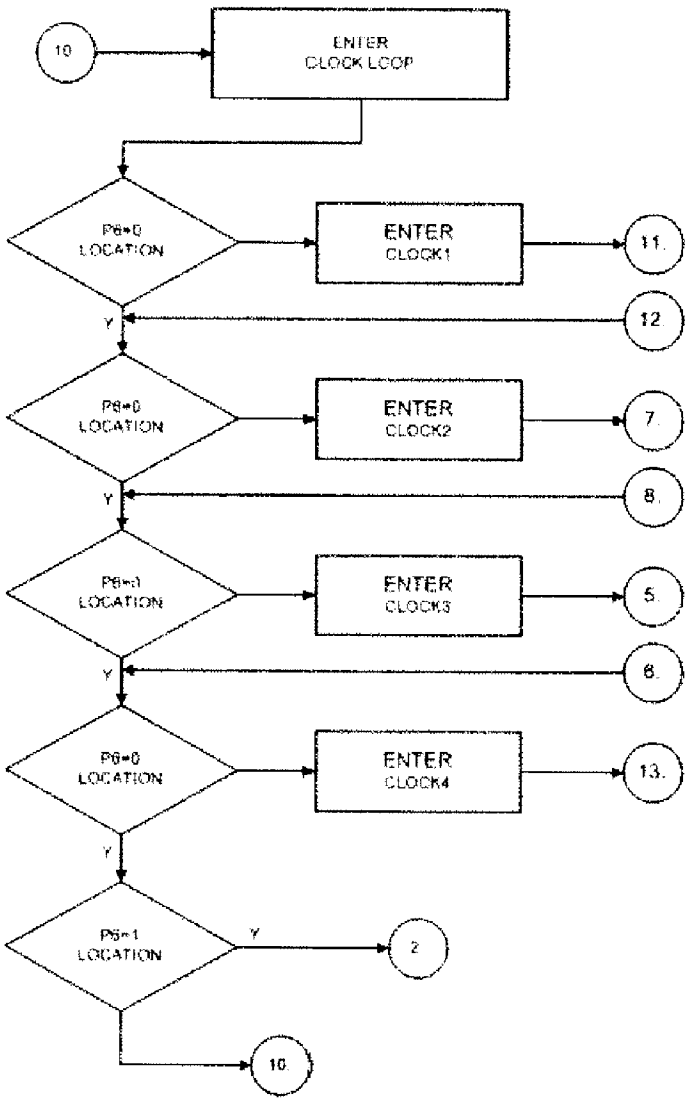
Figure 14:
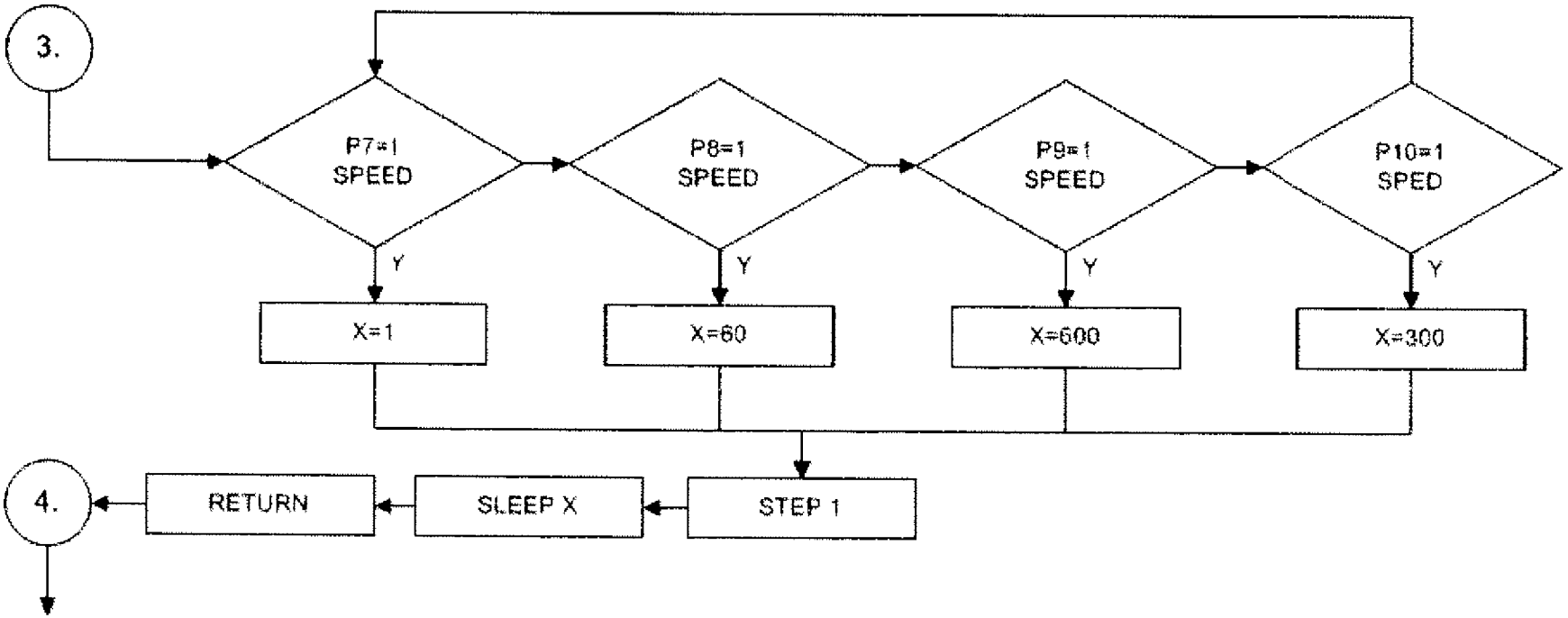
Figure 14:
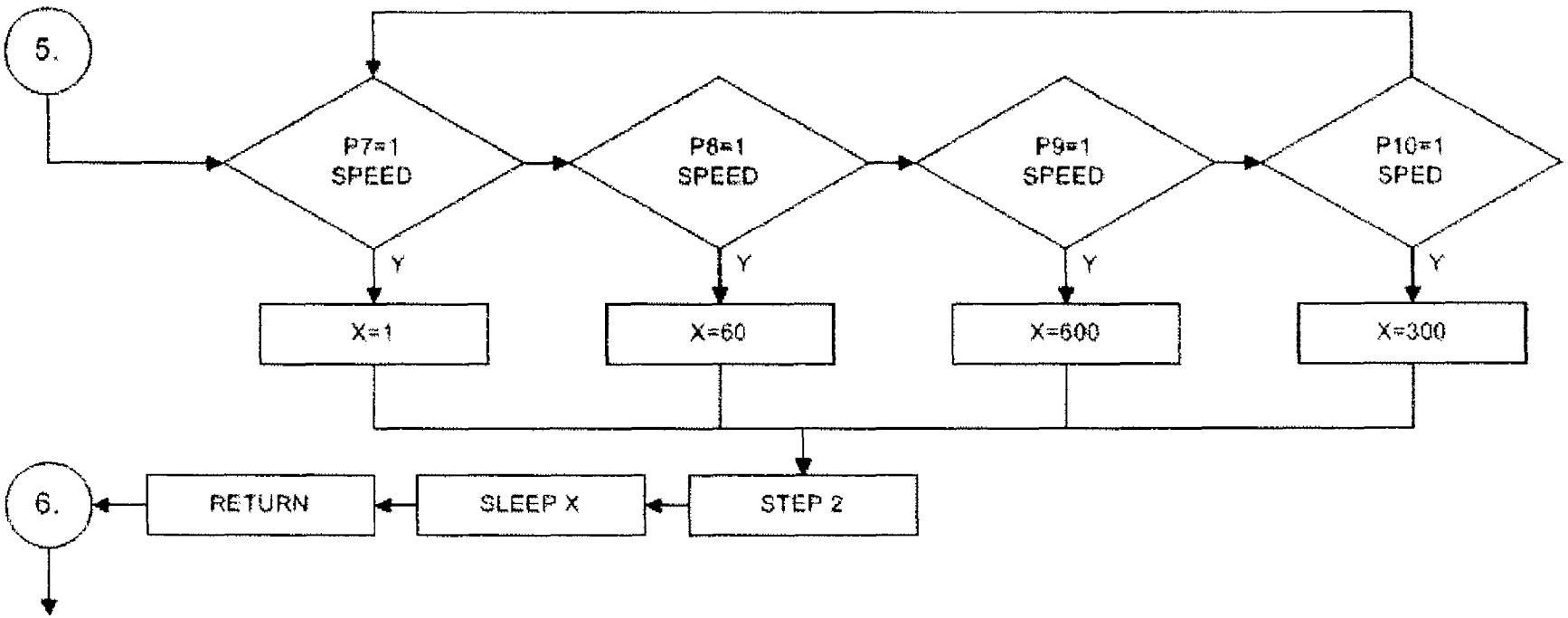
Figure 14:
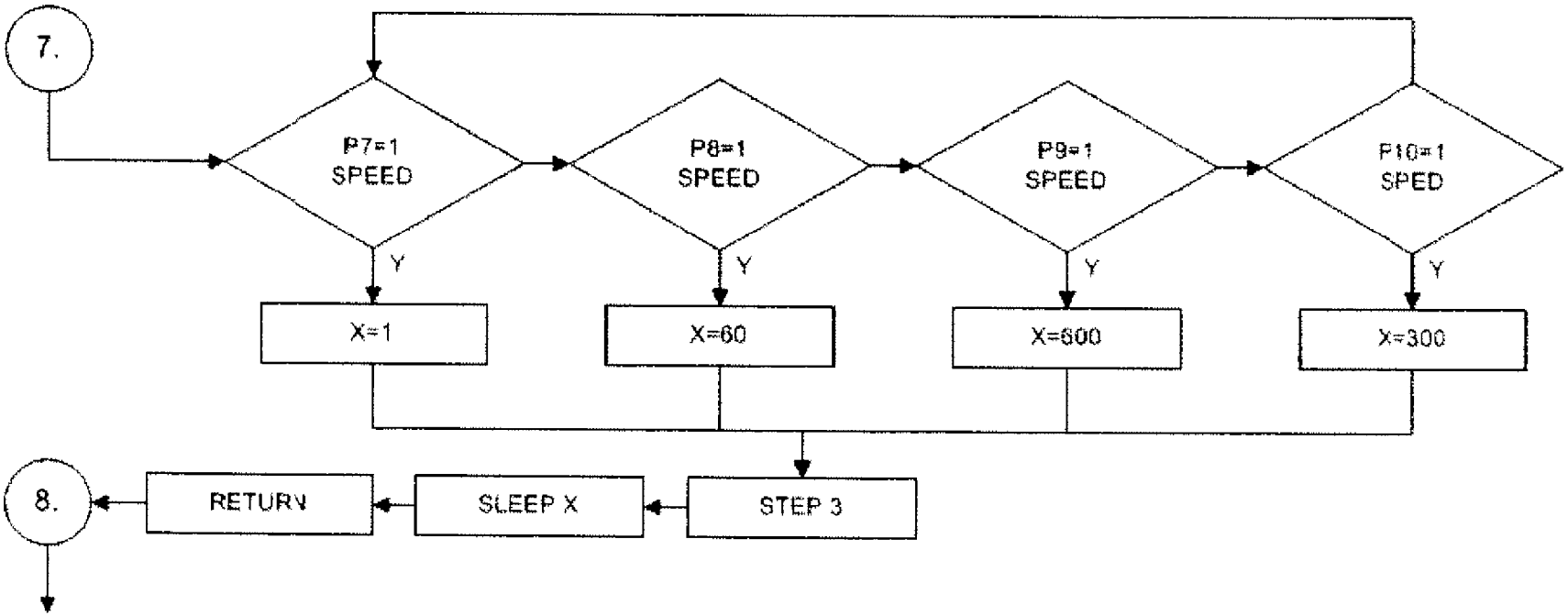
Figure 14:
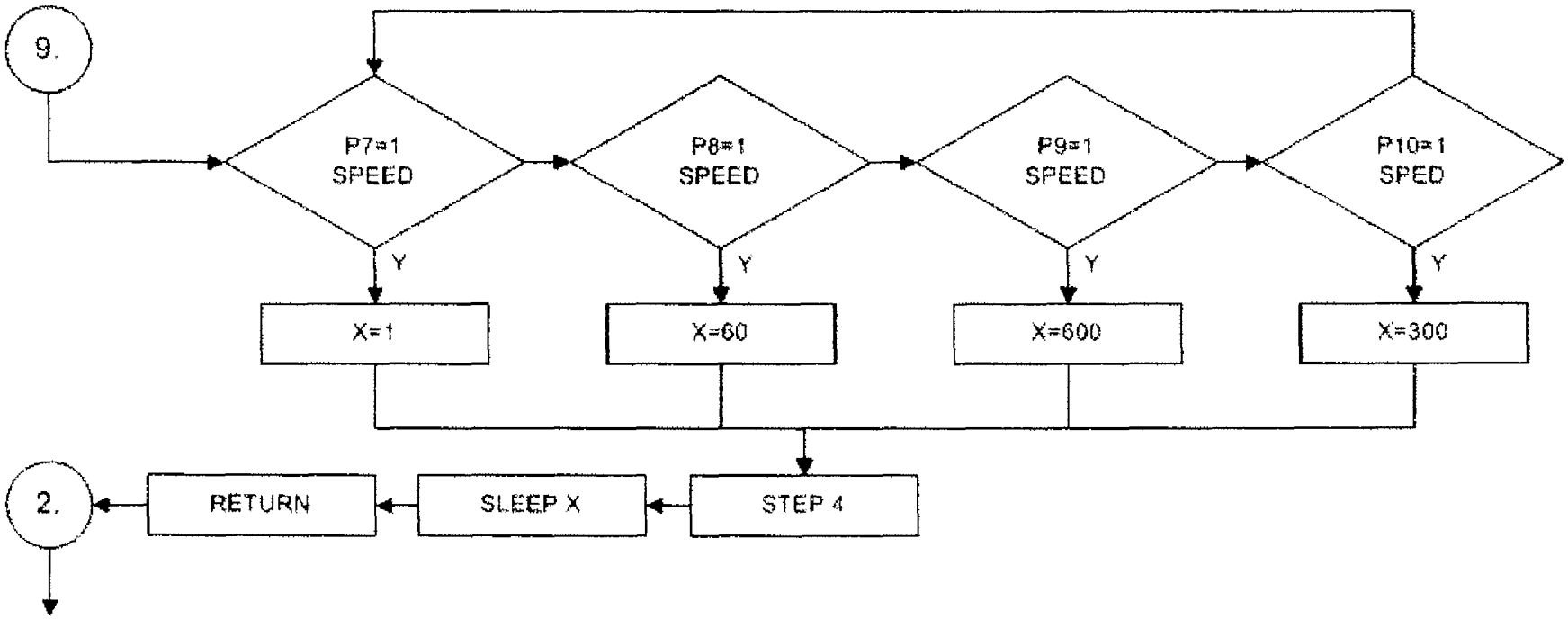
Figure 14:
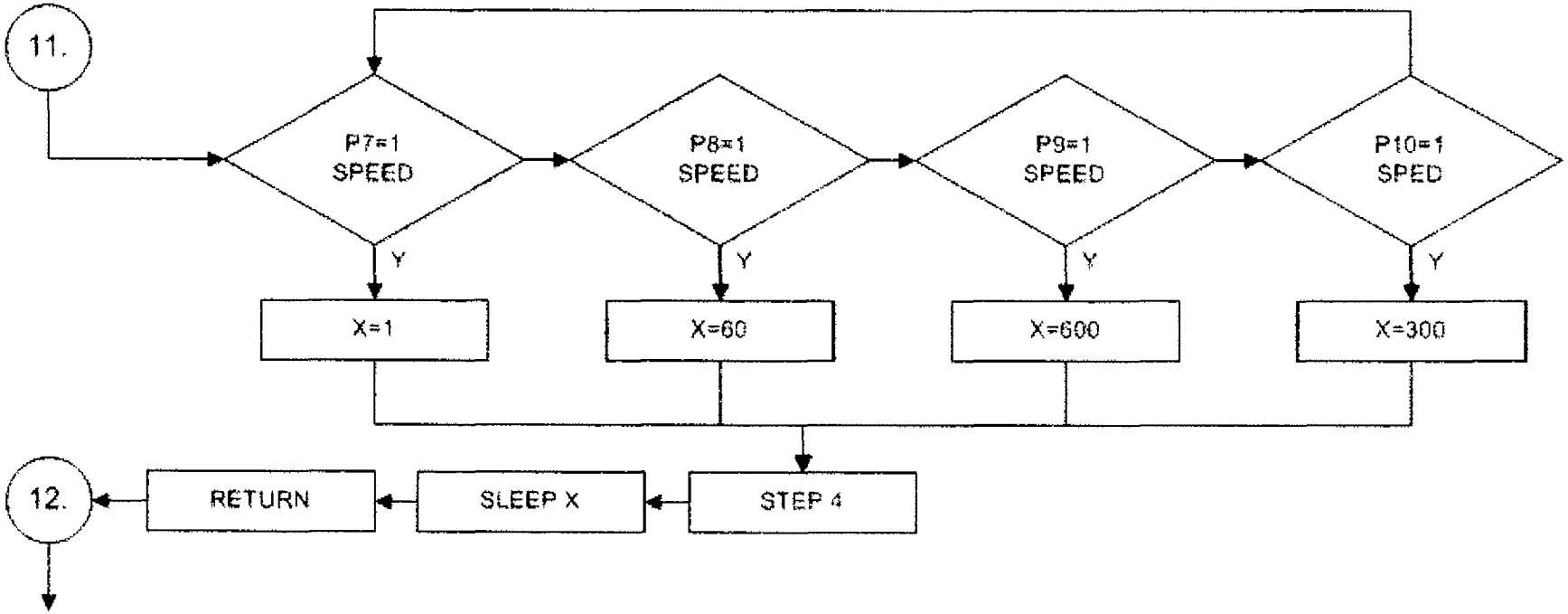
Figure 14:
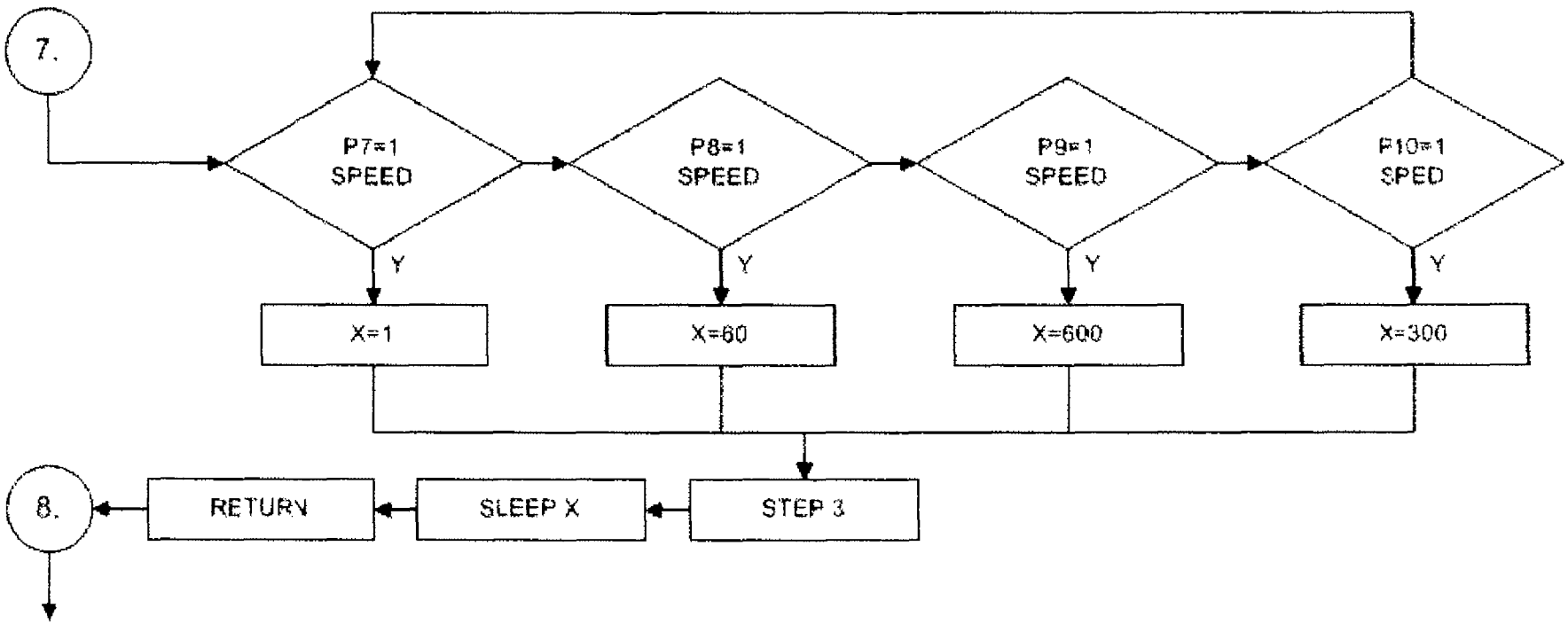
Figure 14:
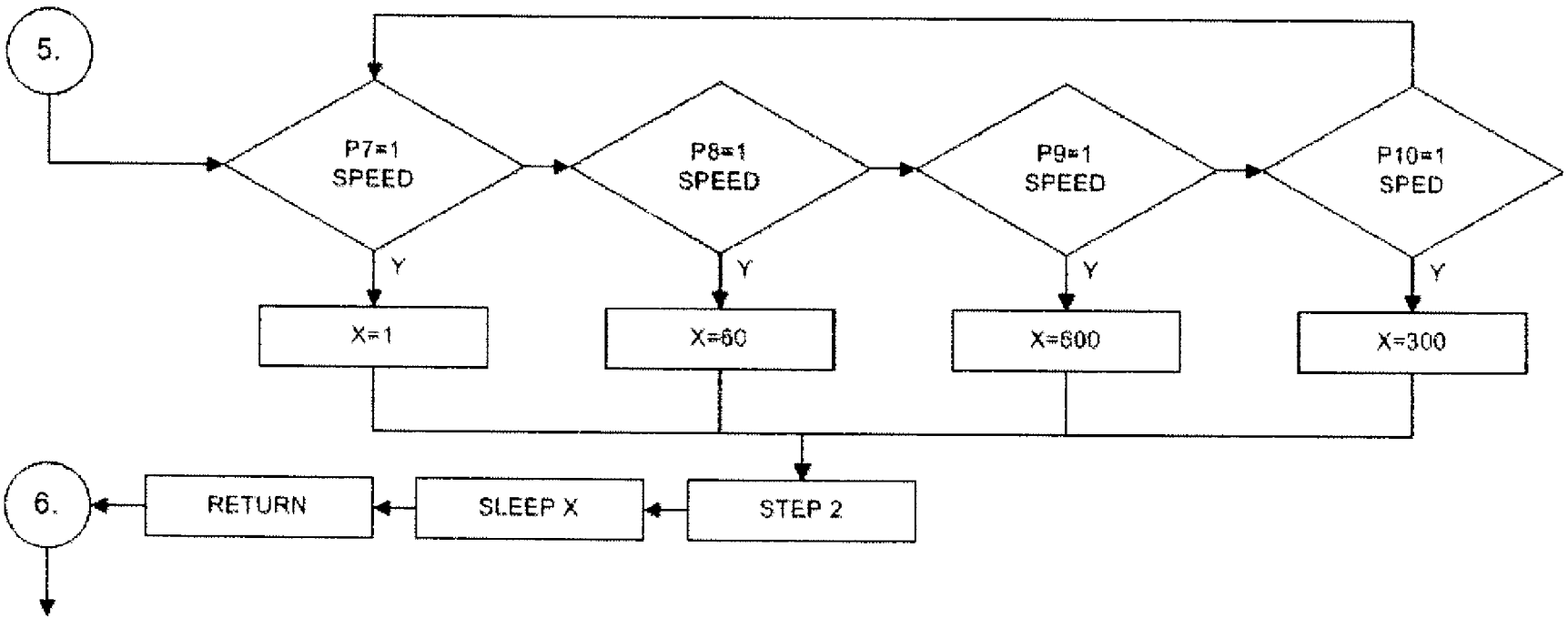
Figure 14:
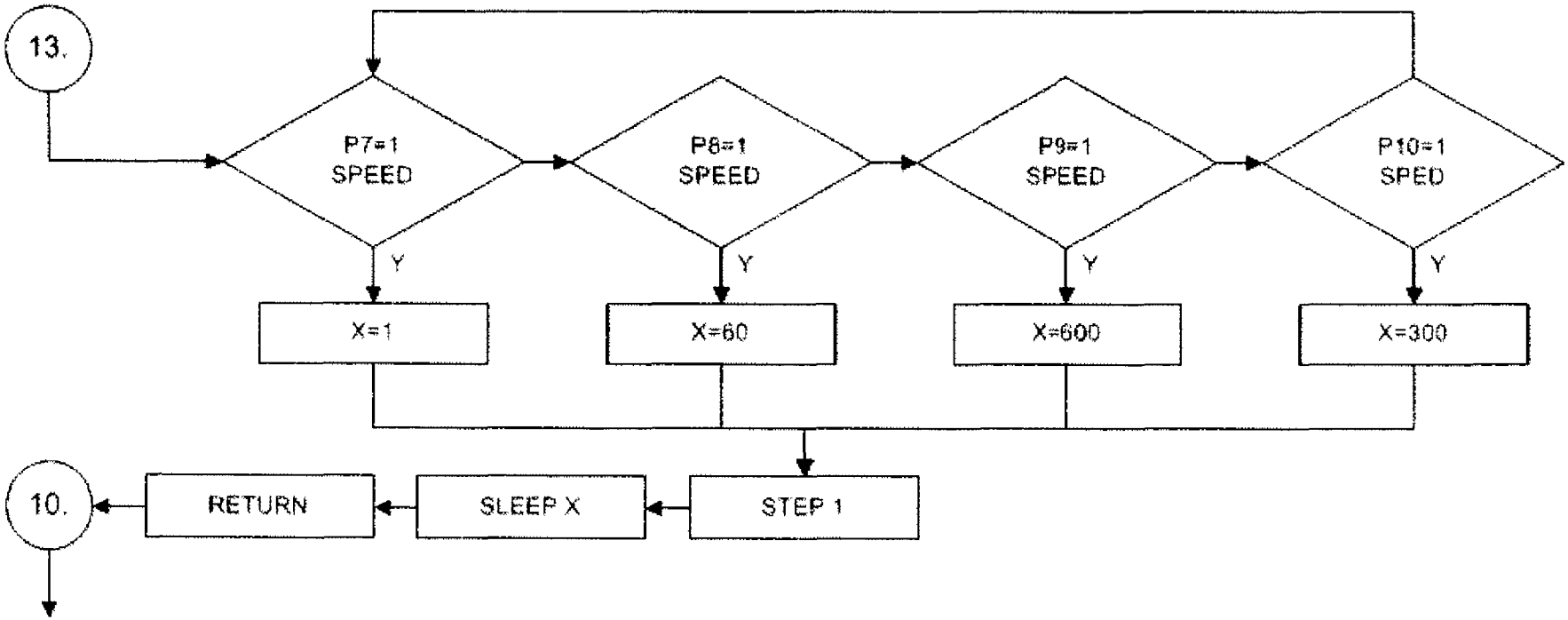

Now referring to the series of drawings, FIGS. 14 (A) through (K), exemplary methods for controlling and operating the present systems are depicted. The following discussion is a general and exemplary description of one or more particular illustrative embodiments.

Generally, the device is turned ON using a Power switch that allows the user to control power into the system. The device then rotates in one direction until it reaches its rotational limit. It then changes direction and rotates until it reaches its opposite limit. The device will continue to rotate between these two limits until it is shut down or it is interrupted by pending safety circuits. The maximum range of motion to either side is programmable and may have built in maximum safety limits such as software, electrical hardware, and mechanical hardware safety limits.

The mechanical assembly (e.g., the support structure on which the child's head is placed) is controlled through a programmable microcontroller. After power is applied the program written in the microcontroller initiates. In some embodiments, the first step in the program allows for the device to locate its position. This is done by commanding the device to rotate in one direction until it reaches the position sensor located at the rotational limit of the device in that direction. When the rotating plate of the support structure or head rest of the device reaches proximity of the sensor the sensor sends a signal to the microcontroller which dives the plate to pause and start the rotation program in the opposite direction. The microcontroller then reads for a speed input.

The speed of the device (e.g., its angular velocity and acceleration) may be controlled through variable switching which is chosen by the user or as discussed elsewhere, using any suitable interface element such as a dial or knob or slider control. The speed is indicated by the pause time in between steps of the motor driving the rotation motion. In some embodiments, the slowest speed would have the longest pause time in between steps and the highest speed would have the shortest pause time and so fourth. In other embodiments having a different type of prime mover (motor) the actual speed of the motor, or the arrangement of a flexible gearing assembly can determine the rate of movement of the head support structure. The speed control panel provides an independent signal to the microcontroller and each signal indicates a different pause time in between steps. In some embodiments, after every step the microcontroller reads these inputs to determine whether it needs to change the pause time in between steps thus changing the speed.

The rotation program then drives the plate of the head support structure to rotate at the established speed. After each step the rotation program continues to read for signal indicating a change in speed settings and/or a direction signal indicating the position sensor in that rotational direction has been reached. When a position sensor is signaled the microcontroller drives the plate to pause, change direction and start the rotation program again. This continues until power is removed or it is interrupted by pending safety circuits.

The steps shown in the logical flowcharts can be implemented in software and/or hardware in a number of ways, such as by programming instructions executed in a microprocessor. Specifically, such as instructions written in a programming language, e.g., in BASIC, C, C++, PASCAL, APL, or Assembly language or other suitable high-level or object code or machine code suitable for a particular embodiment. It should be understood that the exact steps and their ordering can be flexible to accommodate other particular implementations and that the sequence of operations shown in the present illustrative embodiments is merely by way of example and not by way of limitation.

Also, the particular sequence of steps can be influenced or determined by the particular condition being addressed by the system. For example, in treating plagiocephaly the system can be programmed to execute one type of algorithm, while in treating torticollis the system can be programmed to execute another type of algorithm. The algorithm and corresponding instruction steps can be additionally influenced by parameters such as a chid's age, weight, etc.

In addition to the preferred and illustrative examples and embodiments given above, it is possible to make the present system to cause movement, rocking, or rotation to alleviate other types of disorders, such as bed sores as experienced by the elderly and bed-ridden individuals and those with limited mobility. The overall size and motor power of the system can be adjusted to meet these other needs, and the dimensions of the system and its particular geometry and configuration should be understood as flexible. Additionally, the logical and microprocessor-controlled programs running within the system to control its operation should be understood to be flexibly designed to accommodate other therapeutic and preventional modes of operation.

The present disclosure is not intended to be limited by its preferred embodiments, and other embodiments are also comprehended and within its scope. Numerous other embodiments, modifications and extensions to the present disclosure are intended to be covered by the scope of the present inventions as claimed below. This includes implementation details and features that would be apparent to those skilled in the art in the mechanical, logical or electronic implementation of the systems described herein.

What is claimed is:

1. A method for controllably moving at least the head and neck of a resting child with respect to the remaining parts of the child's body, comprising:

providing a support structure for resting at least the head of said child thereon while leaving the remaining parts of the child substantially unsupported by said support structure;

providing power to drive a prime mover coupled to said support structure in a controlled side to side rotational movement about an axis substantially parallel to a long axis (head to toe) of said child's body; and activating a control program which controls a movement of said support structure to cause a programmed movement of said support structure so as to cause at least said child's head to rotate from side to side with respect to the remainder of the child's body.

2. The method of claim 1, said act of providing the support structure comprising providing a contoured support structure that is lower near its center than at its sides so as to comfortably and securely the head of said resting child.

3. The method of claim 1, said act of providing power to drive the prime mover comprising providing power to an electrical stepping motor.

4. The method of claim 1, said act of activating the control program comprising activating the control program using a user interface panel.

5. The method of claim 1, further comprising controlling a speed of said prime mover's movement.

6. The method of claim 1, further comprising coupling said control program and an external programming device in order to program said control program using the external programming device.

* * * * *